US008308239B2

(12) United States Patent
Lundeen

(10) Patent No.: US 8,308,239 B2
(45) Date of Patent: Nov. 13, 2012

(54) INFANT SUPPORT STRUCTURE WITH SUPPORTED SEAT

(75) Inventor: Michael Lundeen, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 140 days.

(21) Appl. No.: 12/719,106

(22) Filed: Mar. 8, 2010

(65) Prior Publication Data

US 2010/0231015 A1 Sep. 16, 2010

Related U.S. Application Data

(60) Provisional application No. 61/159,706, filed on Mar. 12, 2009.

(51) Int. Cl.
*A47D 13/04* (2006.01)

(52) U.S. Cl. ..... 297/274; 297/5; 297/273

(58) Field of Classification Search ..... 297/273, 297/274, 5

See application file for complete search history.

(56) References Cited

U.S. PATENT DOCUMENTS

| | | | | |
|---|---|---|---|---|
| 16,150 A | | 12/1856 | Robbins | |
| 75,274 A | | 3/1868 | Hurd | |
| 97,078 A | | 11/1869 | Goulding | |
| 517,403 A | | 3/1894 | Bradish et al. | |
| 823,812 A | | 6/1906 | Ritter | |
| 903,731 A | | 11/1908 | Kull | |
| 1,141,123 A | * | 6/1915 | Knight | 297/5 X |
| 1,204,249 A | * | 11/1916 | Condon, Jr. | 297/5 X |
| 1,326,921 A | * | 1/1920 | Dzimitowicz | 297/5 |
| 1,688,922 A | * | 10/1928 | Dronisky, Jr. | 297/5 X |
| 1,949,594 A | | 3/1934 | Wightman | |
| 2,252,224 A | | 8/1941 | Welsh | |
| 2,618,318 A | | 11/1952 | Welsh | |
| 2,700,413 A | * | 1/1955 | Williams | 297/274 X |
| 2,723,856 A | | 11/1955 | Thomson | |
| 2,733,755 A | | 2/1956 | Boucher | |
| 2,736,131 A | | 2/1956 | Lewis, Jr. | |
| 2,756,051 A | | 7/1956 | Shone | |
| 2,758,634 A | | 8/1956 | Welsh et al. | |
| 2,851,271 A | | 9/1958 | Suter | |
| 2,927,628 A | | 3/1960 | Gill | |
| 2,935,318 A | | 5/1960 | Stukenborg | |
| 3,007,667 A | | 11/1961 | Rossi | |
| 3,054,591 A | | 9/1962 | Cohn | |
| 3,066,906 A | | 12/1962 | Berlin | |
| 3,076,628 A | | 2/1963 | Smith et al. | |

(Continued)

FOREIGN PATENT DOCUMENTS

| | | |
|---|---|---|
| JP | 9-70340 | 3/1997 |

(Continued)

OTHER PUBLICATIONS

International Search Report and Written Opinion for PCT/US2010/026586, 8 pages, dated Oct. 11, 2010.

*Primary Examiner* — Rodney B White

(74) *Attorney, Agent, or Firm* — Edell, Shapiro & Finnan, LLC

(57) ABSTRACT

An infant support structure that supports a child above a support surface is disclosed. The infant support structure includes a frame, a seat, and an elastic member that supports the seat for vertical and horizontal movement relative to the frame.

20 Claims, 23 Drawing Sheets

U.S. PATENT DOCUMENTS 3,096,963 A 7/1963 Welsh
3,157,430 A 11/1964 Hamilton
3,180,679 A 4/1965 Berlin
3,331,631 A 7/1967 Pierson, Jr.
3,406,934 A 10/1968 Grudoski
3,427,071 A 2/1969 Pierson, Jr.
3,656,728 A 4/1972 Griggs
3,690,652 A 9/1972 Schneider
3,692,359 A 9/1972 Boucher
3,747,596 A 7/1973 Mills
3,759,539 A 9/1973 Goldberg
3,796,430 A 3/1974 Sudo
3,839,754 A 10/1974 Hooper
4,188,745 A 2/1980 Harvey et al.
4,226,467 A 10/1980 Boudreau
4,722,713 A 2/1988 Williams et al.
4,743,008 A 5/1988 Fermaglich et al.
5,451,093 A * 9/1995 Petrie et al. ..... 297/137
5,499,949 A 3/1996 Heubl
5,518,475 A 5/1996 Garland
5,688,211 A 11/1997 Myers
5,690,383 A 11/1997 Meeker
5,700,201 A 12/1997 Bellows et al.
5,857,944 A 1/1999 Cone et al.
5,934,747 A 8/1999 Garland
6,030,039 A 2/2000 Essler
6,036,604 A 3/2000 Klitsner
6,126,236 A 10/2000 Wu
6,260,867 B1 7/2001 Yang et al.
6,299,247 B1 10/2001 Meeker et al.
6,332,646 B1 12/2001 Tseng
6,808,437 B2 10/2004 Podd et al.
6,817,864 B1 11/2004 Martinez
6,824,207 B1 11/2004 Lin
6,840,573 B1 1/2005 Yao
6,854,799 B1 2/2005 Asbach et al.
6,883,862 B1 4/2005 Yao
6,896,575 B2 5/2005 Fair et al.
6,932,709 B1 8/2005 Gubitosi et al.
6,957,852 B1 10/2005 Hsieh
7,017,924 B1 3/2006 Lambert
7,144,078 B2 12/2006 Hsieh
7,178,864 B2 2/2007 Hsieh
7,234,722 B1 6/2007 Madigan et al.
7,344,428 B2 3/2008 Ransil et al.
7,614,930 B2 11/2009 Berkey et al.
7,614,979 B2 11/2009 Thomson et al.
2005/0264088 A1 12/2005 Tadin et al.
2006/0237944 A1 10/2006 Thomson et al.
2007/0021272 A1 1/2007 Slade
2007/0040431 A1 2/2007 Bapst et al.
2007/0224909 A1 9/2007 Schoenfelder et al.
2008/0271241 A1 11/2008 Tholkes et al.
2009/0230735 A1 9/2009 Chen

FOREIGN PATENT DOCUMENTS

JP 2001017280 A 1/2001

* cited by examiner

INFANT SUPPORT STRUCTURE WITH SUPPORTED SEAT

CROSS-REFERENCE TO RELATED APPLICATIONS

This application claims the benefit of and priority under 35 U.S.C. 119(e) to U.S. Provisional Patent Application No. 61/159,706 entitled "Infant Support Structure with Supported Seat," filed Mar. 12, 2009, the entire disclosure of which is incorporated herein by reference.

FIELD OF THE INVENTION

The present invention relates to an infant support structure and in particular, to an infant support structure that supports a child above a support surface. The present invention also relates to an infant support structure that includes a frame, a seat, and a member that supports the seat for movement in various directions relative to the frame.

BACKGROUND OF THE INVENTION

Infant support structures typically support an infant or child above a support surface, such as a floor or the ground. Some infant support structures include a seat that is configured to support a child so that the child can bounce while being supported by the seat. For example, a bouncer includes a frame that is configured to allow a child supported thereon to bounce relative to the support surface. However, the particular movement of the child on the structure and the resulting entertainment for the child is limited.

Thus, there is a need for an infant support structure that facilitates different movements of a child supported by the structure. In addition, there is also a need for an infant support structure that includes a feature that can be used to entertain a child supported by the structure.

SUMMARY OF THE INVENTION

In one embodiment, an infant support structure includes a seat portion, a frame, and an elastic member. The seat portion has an outer perimeter, the frame includes an upper portion and a support portion coupled to the upper portion, the support portion being configured to engage a support surface, the upper portion substantially surrounding the seat portion, and the elastic member is coupled to the frame and to the seat portion, the elastic member substantially surrounding the seat portion. The upper portion of the frame may be substantially circular and may surround the outer perimeter of the seat portion. In one embodiment, the elastic member is a stretchable fabric material that extends between the seat portion and the frame. An object may be coupled to the elastic member so that movement of a child in the seat portion results in movement of the elastic member which imparts movement to the object.

In one embodiment, the infant support structure may include a resilient member coupled to the frame and to the seat portion, the resilient member supporting the seat portion from the frame. In addition, the resilient member is an elongate member that is coupled to the frame and the seat portion and in one implementation, the resilient member is located beneath the elastic member.

In another embodiment, a structure for supporting a person above a support surface has a frame including an outer member and legs supporting the outer member above the support surface, a seat configured to receive a child therein, a suspension mechanism coupled to the frame outer member and to the seat, and an elastic member coupled to the frame outer member and to the seat, the elastic member being substantially planar and configured to support objects placed thereon.

The suspension mechanism supports the seat from the frame, the seat being movable relative to the frame. In one embodiment, the suspension mechanism is an elastic elongate member that is coupled to the seat and to the frame. In addition, the elastic member may be a stretchable fabric material. The outer member of the frame defines a substantially circular opening, the seat is placed in the opening, and the elastic member is disposed between the outer member and the seat and surrounds the seat. In one implementation, the structure includes at least one toy that is coupled to the elastic member and configured to move when motion is imparted to the elastic member.

In one embodiment, the infant support structure includes a seat configured to receive an infant, a frame configured to engage a support surface, a coupler connected to the seat and to the frame, the coupler supporting the seat from the frame for movement relative to the support surface, and an elastic member connected to the seat and to the frame, the elastic member substantially surrounding the seat. In one embodiment, the coupler is elastic and resiliently supports the seat for movement relative to the support surface, the coupler configured to bear a portion of a weight of an infant placed in the seat. The coupler may be an elongate member that is coupled to the frame at a plurality of locations and to the seat at a plurality of locations.

In an alternative embodiment, the infant support structure includes a limit mechanism connected to the frame and to the seat, the limit mechanism configured to limit the extent of movement of the seat relative to the support surface. The limit mechanism may also include a flexible material. In different implementations, the coupler is disposed beneath the elastic member and the frame is collapsible.

In one embodiment, the infant support structure includes a frame that movably supports a seat for a child. The frame rests on a support surface, such as the ground or a floor, and one ore more elastic members are connected between the frame and the seat. In one implementation, the seat has an unloaded mode and a loaded mode. In the unloaded mode, the seat is in a rest or unbiased position when no child is in the seat. In this position, the seat is suspended above the support surface in a general stable position. In the loaded mode, the seat is loaded by the weight of a child and when the child moves, the seat moves up and down relative to the rest position.

In one embodiment, the infant support structure includes a limit member or mechanism that is coupled to the seat and to the frame. The limit member is configured to limit the range of motion of the seat relative to the frame. Accordingly, the movement of the limit member in any direction is limited by the limit member. In one embodiment, a single limit member is used. In other embodiments, more than one limit member is used. The limit member may be a single piece of material that extends substantially around the seat. Alternatively, the limit member may be short members such as straps that are spaced apart around the perimeter of the seat.

As an infant or child in the infant support structure moves, such as by bouncing up and down or side-to-side, motion is imparted to the resilient or elastic member or portion as well. When an object is coupled to or placed on the elastic member, motion is imparted to the object accordingly.

BRIEF DESCRIPTION OF THE DRAWINGS

Like reference numerals have been used to identify like elements throughout this disclosure.

DETAILED DESCRIPTION OF THE INVENTION

The term "infant support structure" and "support structure" may be used interchangeably herein to refer to a structure that can be configured to hold and support a child or infant. The terms "infant" and "child" may be used interchangeably herein. The terms "seat" and "seat portion" may be used interchangeably herein to refer to the portion of infant support structure that holds the child. While much of the discussion herein relates to a support structure for use for an infant or child, the concept of a support structure with a frame, a seat portion, and an elastic member is applicable to persons other than infants or children.

Figure 1:
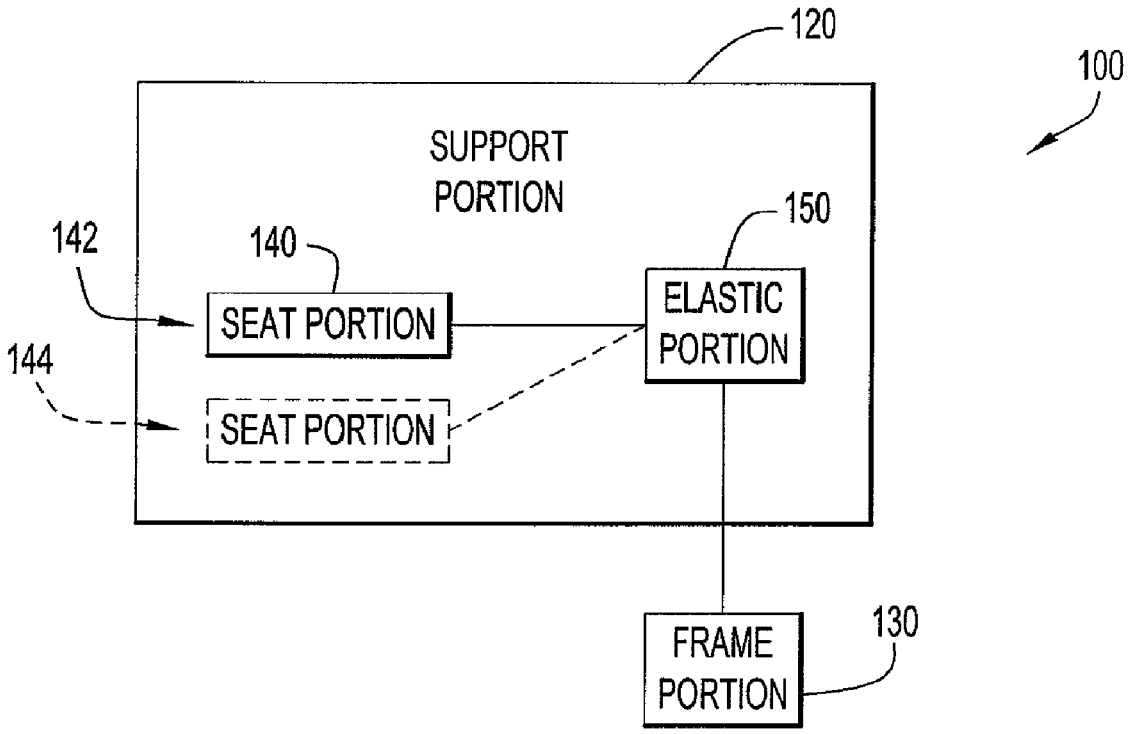
FIG. 1 illustrates a schematic block diagram of an embodiment of an infant support structure according to the invention.

FIG. 1 shows a schematic block diagram illustrating an embodiment of an infant support structure. In this embodiment, the infant support structure 100 includes a support portion or support member 120 and a frame portion or frame member 130. The frame portion 130 may be referred to alternatively as a frame. The frame portion 130 is configured to be placed and supported on a support surface (e.g., a floor or the ground). The seat portion 140 is configured to receive and securely support a child therein.

As shown in FIG. 1, the support portion 120 includes a seat or seat portion 140 and an elastic portion 150. While only one elastic portion 150 is illustrated in FIG. 1, in different embodiments, the infant support structure 100 may include more than one elastic portion 150. The elastic portion 150 is connected to the frame portion 130 and to the seat portion 140 so that the elastic portion 150 supports the seat portion 140 from the frame 130. The seat portion 140 is suspended above a support surface by the elastic portion 150. Accordingly, the seat portion 140 can move relative to the support surface and to the frame 130.

The seat portion 140 has an unloaded, rest position 142 when no child is placed in the seat portion 140. In this position 142, the seat portion 140 is suspended at a particular distance above the support surface. When the seat portion 140 is loaded, such as when a child is placed in seat portion 140, the seat portion 140 is displaced from the rest position 142 to a lower position 144. The elastic portion 150 is resilient and supports the seat portion 140 for movement above and below the rest position 142.

Figure 2:
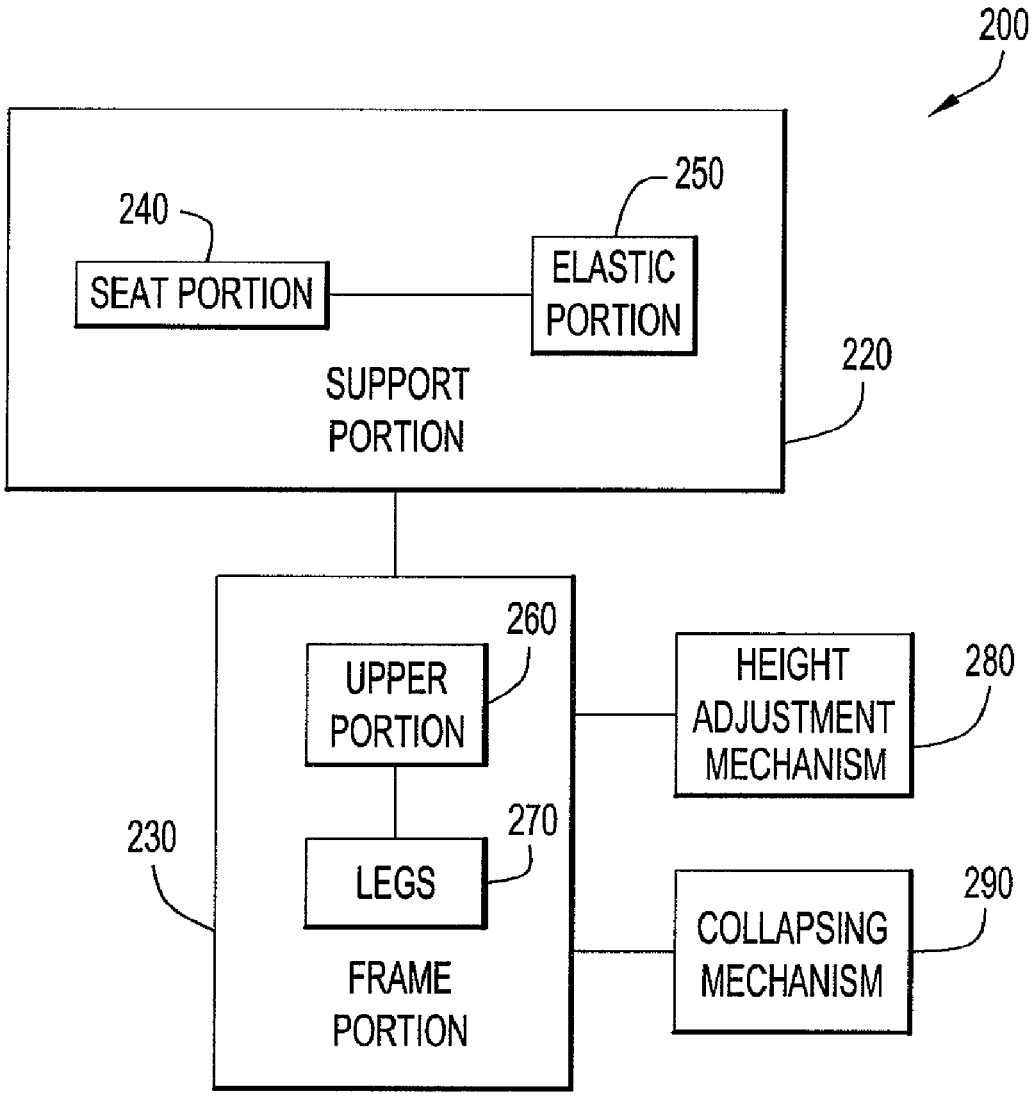
FIG. 2 illustrates a schematic block diagram of an alternative embodiment of an infant support structure according to the invention.

FIG. 2 shows a schematic block diagram of an alternative embodiment of an infant support structure. In this embodiment, the infant support structure 200 includes a support portion 220 and a frame portion 230. The support portion 220 includes a seat portion 240 and an elastic portion 250 coupled to the seat portion 240.

The frame portion 230 includes an upper portion 260 and several legs 270 coupled to the upper portion 260. The legs 270 are configured to engage a support surface, such as a floor or the ground, and to support the upper portion 260. One or more of the legs 270 may include a height adjust mechanism 280 that can be manipulated by a parent or caregiver to adjust the height of the upper portion 260 relative to the support surface. The height adjustment mechanism 280 may result in reconfiguring one or more legs 270 to position the upper portion 260 at different heights above the support surface. In one implementation, one or more legs 270 may include multiple telescoping parts that are coupled to and slide relative to each other. Alternatively, one or more legs 270 may include multiple parts that are connected to each other via threads to facilitate the adjustment of the height of upper portion 260. In addition, the frame portion 230 may include a collapsing mechanism 290 that can be used to maintain the frame portion 230 in a deployed or use configuration as desired.

Figure 3:
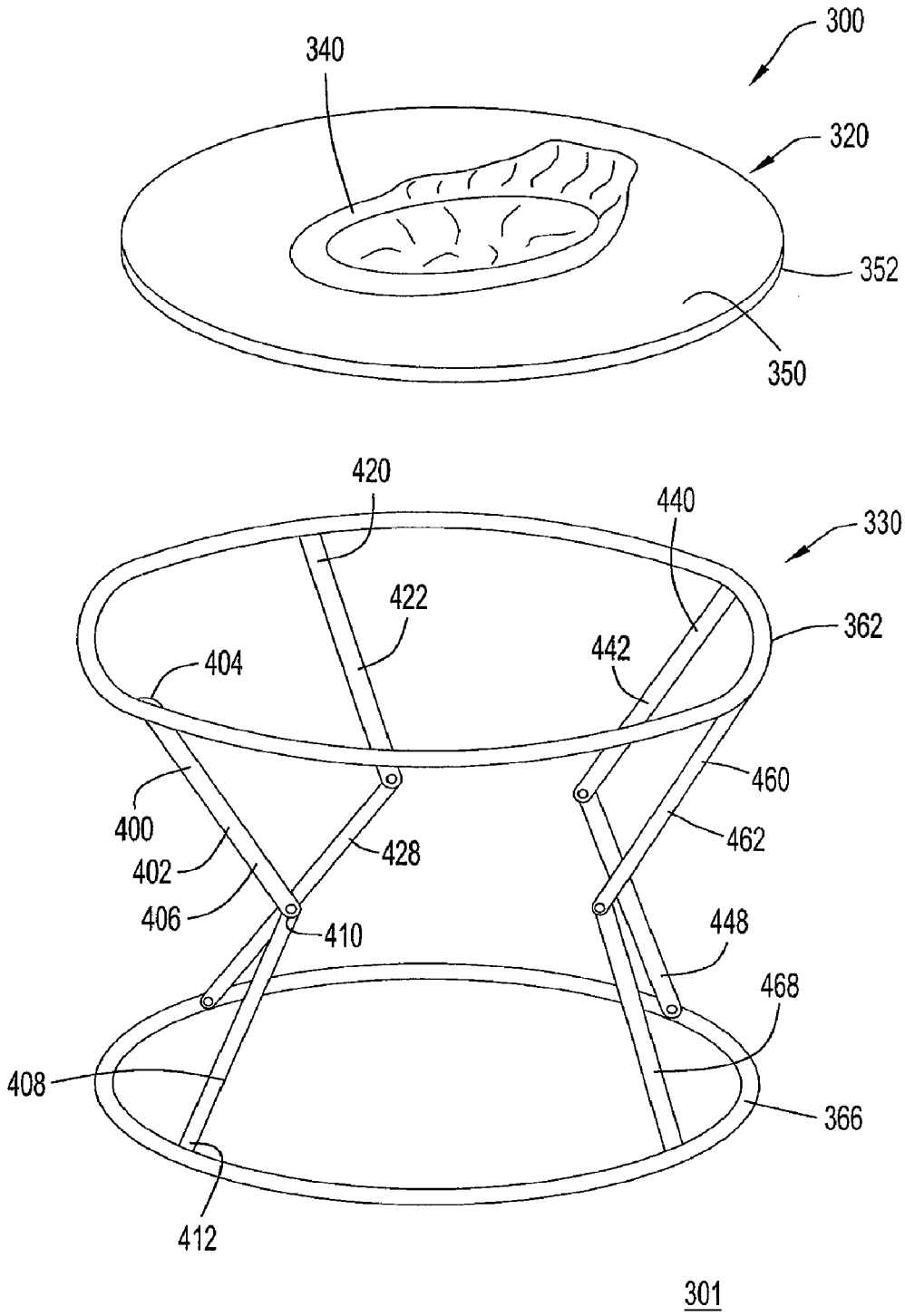
FIG. 3 illustrates a partially exploded view of an embodiment of an infant support structure according to the invention.

Referring to FIG. 3, an embodiment of an infant support structure is illustrated. In this embodiment, the infant support structure 300 includes a support portion or member 320 and a frame portion or member 330. The support portion 320 includes a seat portion 340 and an elastic portion 350. The seat portion 340 is configured to receive and hold an infant or child therein. The elastic portion 350 is connected to the seat portion 340 and to the frame portion 330. In one implementation, the elastic portion 350 may have sufficient strength to support the seat portion 340 from the frame portion 330. In that implementation, a child in the seat portion 340 can bounce up and down and side-to-side via the elastic portion 350.

In one embodiment, the elastic member 350 is made of an elastic material that is sufficiently strong to support the weight of seat portion 340 and an occupant therein. The elastic portion 350 may be a fabric material with elastic properties and may include LYCRA. The elastic portion 350 includes an outer edge or perimeter 352 as shown. The outer edge 352 can be used to engage the frame 330 to couple the elastic portion 350 to the frame 330. The elasticity of the elastic material enables the elastic member 350 to stretch while it allows seat portion 340 to translate vertically. In other embodiments, one or more additional elastic members may be used in additional elastic member 350 to support the seat portion 340 on the frame portion 330.

The frame 330 includes an upper portion 362 that is supported by several legs 400, 420, 440, and 460. The upper portion 362 can be referred to as alternatively an outer member. In the embodiment illustrated in FIG. 3, the frame portion 330 also includes a lower portion 366 that is coupled to the legs 400, 420, 440, and 460. The lower portion 366 is optional in different embodiments based on whether the legs 400, 420, 440, and 460 are sufficiently sturdy and configured to engage the support surface and support the upper portion 362.

In various embodiments, each of the legs 400, 420, 440, and 460 can be a single member or alternatively, formed by coupling together multiple members. In addition, each of the legs 400, 420, 440, and 460 can be fixedly coupled or pivotally coupled to the corresponding one of the upper portion 362 and the lower portion 366. Alternatively, the frame portion 330 may include more or fewer than four legs.

In FIG. 3, each of the legs 400, 420, 440, and 460 is illustrated as including an upper leg member and a lower leg member. As shown, leg 400 includes an upper leg member 402 with opposite ends 404 and 406. Leg 400 also includes a lower leg member 408 with opposite ends 410 and 412. End 404 is coupled to the upper portion 362 via a connector and end 406 is coupled to end 410 of the lower leg member 408 via a connector. In addition, end 412 of the lower leg member 408 is coupled to the lower portion 366 via a connector.

Similarly, leg 420 includes an upper leg member 422 and a lower leg member 428, leg 440 includes an upper leg member 442 and a lower leg member 448, and leg 460 includes an upper leg member 462 and a lower leg member 468. Each of the ends of the legs 420, 440, and 460 is coupled to one of the upper portion 362 and the lower portion 366 by connectors, such as bolts or screws. In one embodiment, the upper leg members and the lower leg member of the legs 400, 420, 440, and 460 are pivotally connected to one of the upper portion 362 and the lower portion 366. In alternative embodiments, the legs 400, 420, 440, and 460 may be formed using a single member that has either a bent configuration or a substantially straight configuration.

In one implementation, the support structure 320 is connected to frame member 330 by fastening the peripheral portion or edge 352 of elastic member 350 to the upper portion 362. When assembled, the upper portion 362 suspends the seat portion 340 of support structure 320 above the support surface 301.

Figure 4:
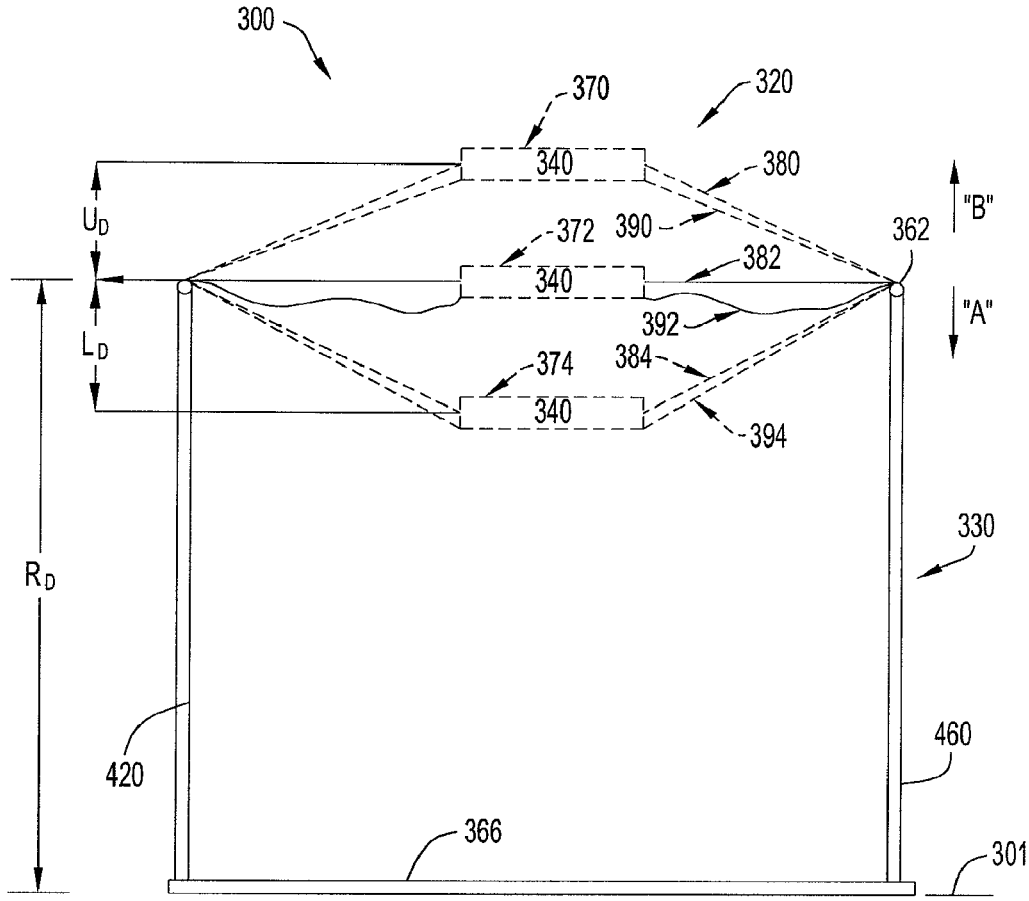
FIG. 4 illustrates a side view of the infant support structure illustrated in FIG. 3, showing the seat portion in different positions.

Referring to FIG. 4, an embodiment of the infant support structure 300 is illustrated showing different positions of the seat portion 340. The infant support structure 300 includes a limit member 360 that limits the range of motion of the seat portion 340. The limit member 360 also suspends the seat portion 340 from the frame portion 330. Depending on the particular position of the seat portion 340, the elastic member 350 and the limit member 360 both suspend the seat portion 340.

In one embodiment, the limit member 360 extends around the perimeter of the seat portion 340. For example, the limit member 360 may be a nylon or TYVEK material, such as a plastic tarp. In an alternative embodiment, the limit member 360 may be one or more elongate members, such as nylon or plastic straps. The multiple straps can be placed around the seat portion 340. In yet another embodiment, the tarp-like material can be placed around the seat 340 and be used with limiting straps spaced around the perimeter of the seat 340.

Referring to FIG. 4, as a child bounces in the seat portion 340 above the support surface 301, the seat portion 340 moves between an upper position 370, a rest position 372, and a lower position 374. As shown, each of the positions 370, 372, and 374 corresponds respectively to elastic member positions 380, 382, and 384 and limit member positions 390, 392, and 394. Seat portion 340 remains in its position 372, which is an unloaded, rest position, when the elastic member 350 is in its position 382 and the limit member 360 is in its position 392. When a child is placed in the seat portion 340, the seat portion 340 moves downwardly along the direction of arrow "A" to its fully loaded position 374 and the elastic member 350 and the limit member 360 are in their lower positions 384 and 394, respectively.

The movement of the seat portion 340 in an upward direction along the direction of arrow "B" is limited to upper position 370 by the limit member 360. In addition, the elastic member 350 may also limit the vertical movement of the seat portion 340. When the seat portion 340 is in its upper position 370, the elastic member 350 and the limit member 360 are in their upper positions 380 and 390. In the upper position 370, the seat portion 340 is upwardly loaded by upward recoil from elastic member 350 and/or from the child's jumping upward off of support surface 301.

As previously described, limit member 360 is connected between seat portion 340 and frame member 330. In seat position 372, the elastic member 350 and limit member 360 support the seat portion 340 above the support surface 301 and the lower portion 366 at a distance designated by distance $R_D$. The limit member 360 limits the downward distance that seat portion 340 can travel relative to rest distance $R_D$ and upper portion 362, this downward distance being illustrated as lower distance $L_D$. In the opposite direction, the limit member 360 limits the upward distance seat portion 340 can travel relative to rest distance $R_D$, and this upward distance is illustrated as upper distance $U_D$. In one embodiment, the lower distance $L_D$ and the upper distance $U_D$ can be approximately four inches. The limit member 360 limits movement of the seat portion 340 to a distance of $R_D$–$L_D$ from the support surface 301. In the opposite direction, the limit member 360 limits movement of the seat portion 340 to a distance equal to $R_D$+$U_D$ from the support surface 301.

The limit member 360 can be implemented in several different ways. For example, the limit member 360 is shown in FIG. 4 as being relatively slack in its rest position 392, but as being taught to absorb load and limit travel in its upper position 390 and its lower position 394. In one embodiment, the limit member 360 can be formed from an inelastic material. Alternatively, it can be formed from an elastic material member that substantially reaches its elastic limit at positions 390 and 394.

In one embodiment, the limit member 360 can also be connected between seat portion 340 and upper portion 362 without much slack. This arrangement can be implemented by forming the limit member 360 from an elastic material that stretches and contracts to accommodate various seat positions. As in the case of a slack limit member 360, a non-slack limit member would also reach its elastic limit at positions 390 and 394 and limit the travel of seat portion 340. Limiting the vertical travel of seat portion 340 prevents a child from operating the infant support structure 300 beyond desired seat position limits.

Figure 5:
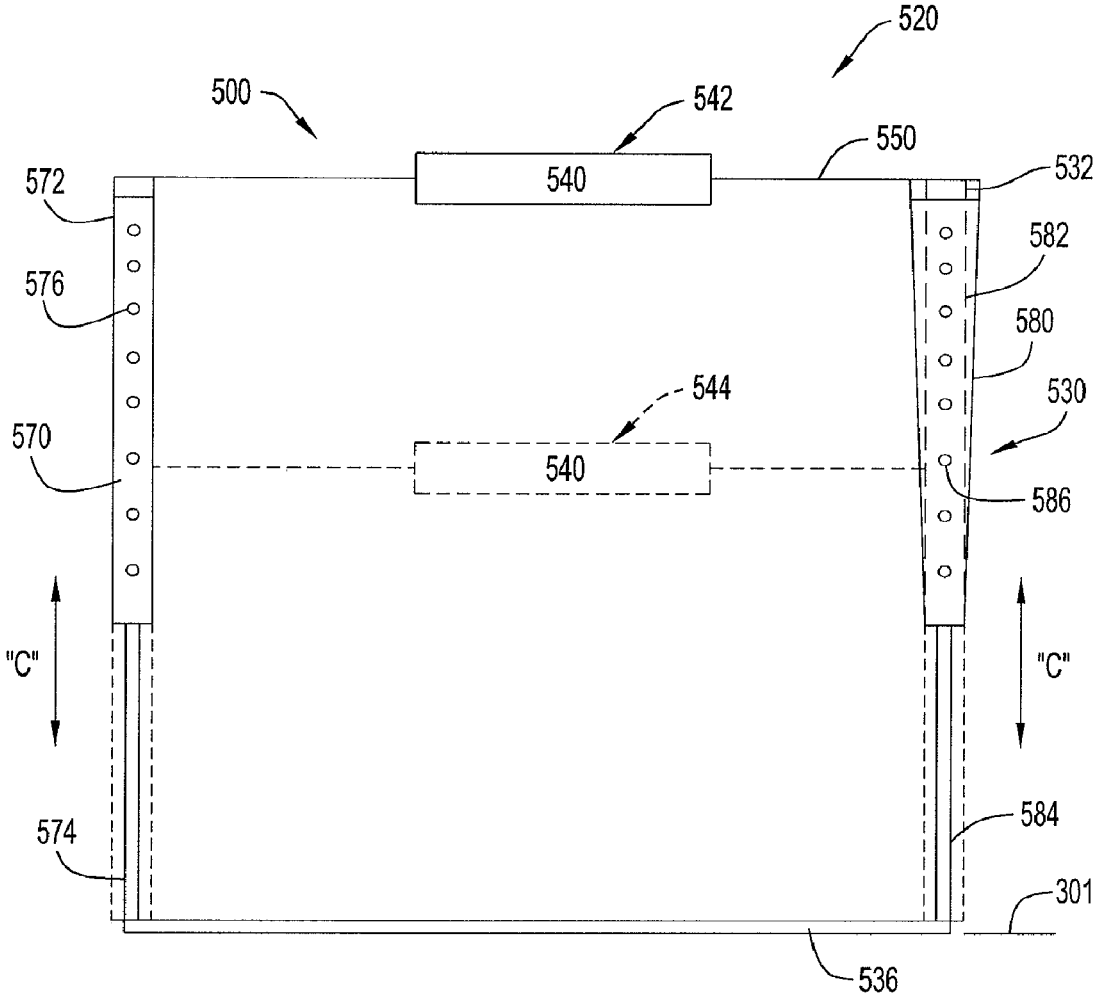
FIG. 5 illustrates a side view of an alternative embodiment of the infant support structure illustrated in FIG. 3, showing the seat portion in different positions.

FIG. 5 illustrates another embodiment of an infant support structure. In this embodiment, the infant support structure 500 includes a support portion 520 and a frame or frame portion 530 that is configured to engage a support surface 301. The support portion 520 includes a seat portion 540 and an elastic member or portion 550 that supports the seat portion 540 from the frame 530. The frame 530 includes an upper member 532 to which the elastic portion 550 can be coupled and a lower member 536. The frame 530 includes legs 570 and 580. In this embodiment, the legs 570 and 580 are coupled to the upper frame member 562 and a lower frame member 566. While two legs are illustrated in FIG. 5, in different embodiments, the quantity of legs of the frame 530 can vary.

As shown in FIG. 5, leg 570 includes an upper leg member 572 and a lower leg member 574. Lower leg member 574 slides telescopically within upper leg member 572 along the direction of arrow "C," which enables the length of the leg 570 to be adjusted. Similarly, leg 580 includes an upper leg member 582 and a lower leg member 584. Lower leg member 584 slides telescopically within upper leg member 582 along the direction of arrow "C," which enables the length of leg 580 to be adjusted. Each of the upper leg members 572 and 582 includes several openings 576 and 586, respectively, that can be used to secure the length of the legs 570 and 580.

When the legs 570 and 580 are locked in particular length positions, the upper member 562 is supported at different corresponding heights above support surface 301. As a result, support structure 520, and thus, seat portion 540 are also supported at different heights above support surface 301. Referring to FIG. 5, different upper and lower positions 542 and 544 of the seat portion 540 are illustrated. The height adjustment features of the legs 570 and 580 enable the seat portion 540 to be placed into various positions relative to the support surface 301. In various embodiments, the quantity of heights at which the seat portion 540 can be placed can vary.

Figure 6:
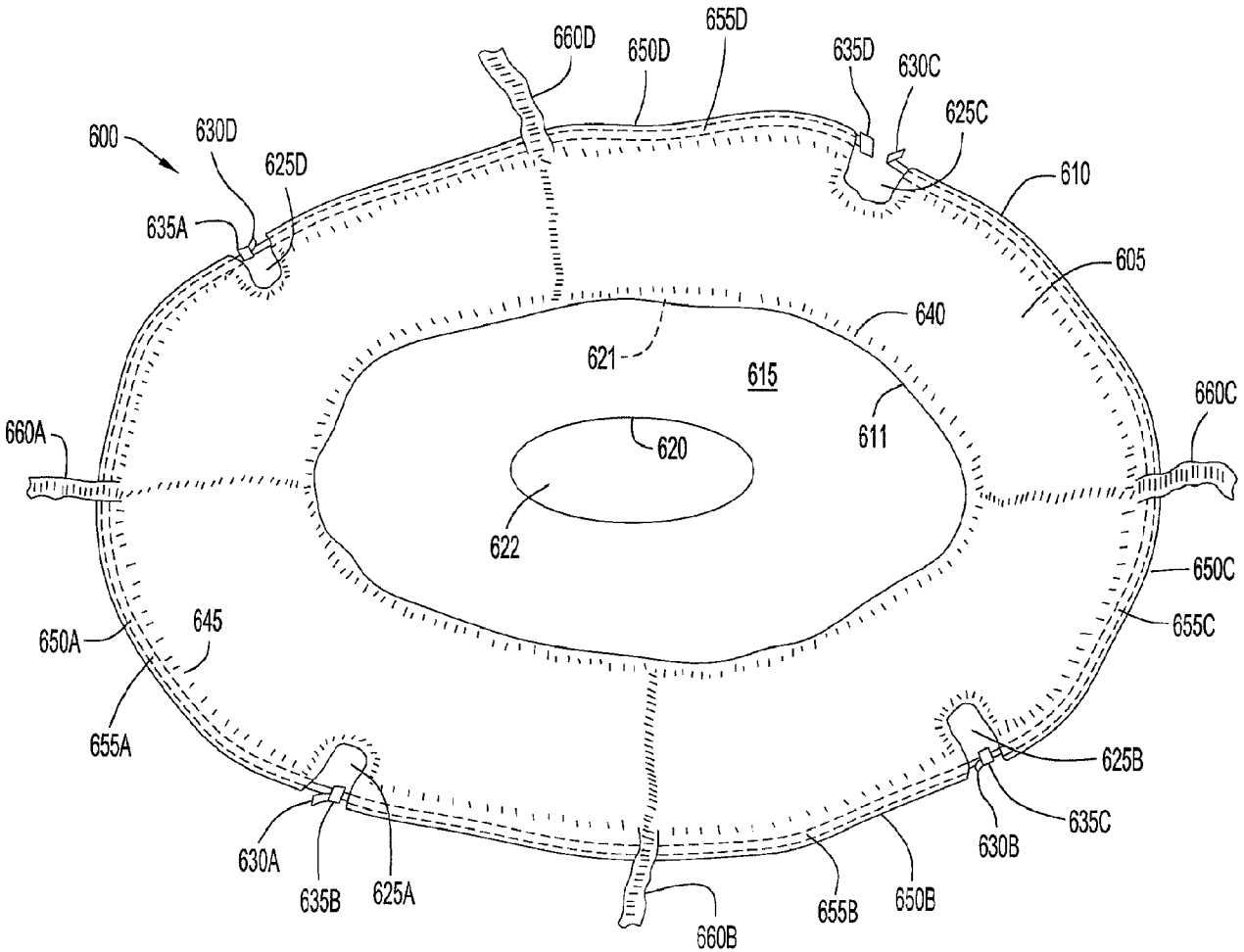
FIG. 6 illustrates a top perspective view of the elastic member of the infant support structure illustrated in FIG. 3.

Referring to FIG. 6, an embodiment of an elastic portion of an infant support structure is illustrated. In this embodiment, the elastic portion 600 includes an outer fabric member 605 and an inner fabric member 615. The outer fabric member 605 is connected to the inner fabric member 615 around the perimeter of the inner fabric member 615. The outer fabric member 605 and the inner fabric member 615 can be sewn together, such as by stitching 640. The outer fabric member 605 has an outer edge 610 and an inner edge 611 and the inner fabric member 615 includes an inner edge 620 and an outer edge 621. The inner edge 620 of the inner fabric member 615 defines a seat opening 622 therethrough. In this embodiment, the outer edge 621 of the inner fabric member 615 and the inner edge 611 of the outer fabric member 605 are coupled together.

In one embodiment, the outer fabric member 605 is made from a different material than inner fabric member 615. For example, outer fabric member 605 may be made from a material that is less elastic than inner fabric member 615. The more resilient and less elastic outer fabric member has sufficient strength to be used as the portion of the outer fabric member 605 that is coupled or mounted to the frame. The inner fabric member 615 may be more elastic to provide a greater bounce and springiness near an infant placed in the seat portion. The bouncing characteristics results in motion of objects placed on or coupled to the inner fabric member 615 as a child bounces in the seat portion.

Figure 12:
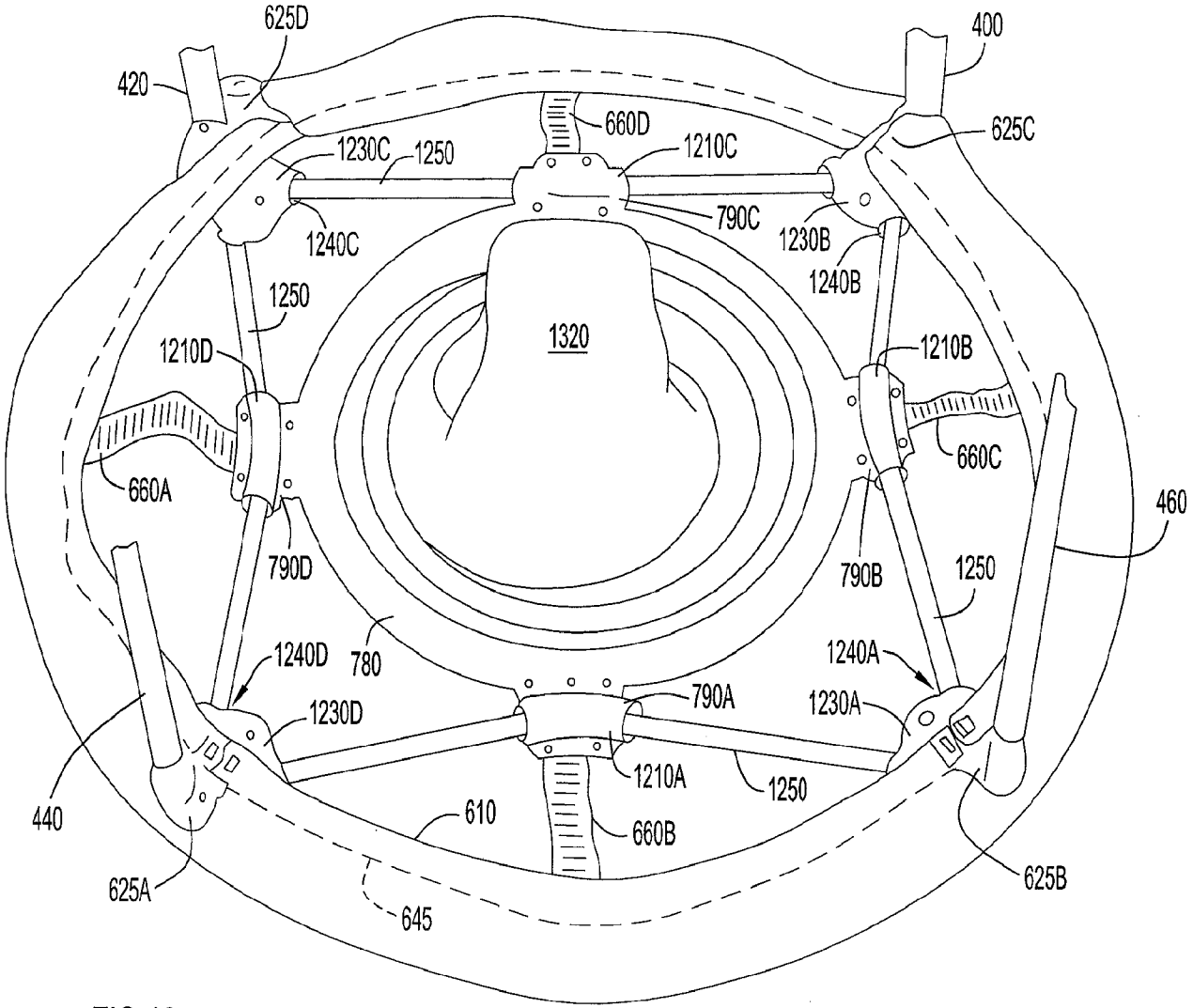
FIG. 12 illustrates a bottom perspective view of an embodiment of an infant support structure according to the invention.

The outer edge 610 includes an outer edge stitch 645 which defines spaced apart channels 650A-D that are located around the perimeter of the edge 610. The outer edge 610 also includes multiple cutouts 625A-D as shown in FIG. 6. In addition, connector straps 655A-D pass respectively through each outer edge channel 650A-D. The ends of connector straps 655A-D terminate in respective cutouts 625A-D and each connector strap 655A-D has a hook end 630A-D and an opposite loop end 635A-D. A hook end from each connector strap and a loop end from an adjacent connector strap are respectively connected to form a continuous connector strap around the perimeter of portion 600. The respective connections formed by the hook ends 630A-D and loop ends 635A-D are exposed in cutouts 625A-D. The continuous connector strap secures the elastic member to the frame by capturing and maintaining the legs of the frame in the cutouts 625A-D. FIG. 6 also shows limit members 660A-D coupled to outer edge 610 and extending away from elastic member 600. The limit members 660A-D are secured to the seat portion as illustrated in FIG. 12 and described below.

Figure 7:
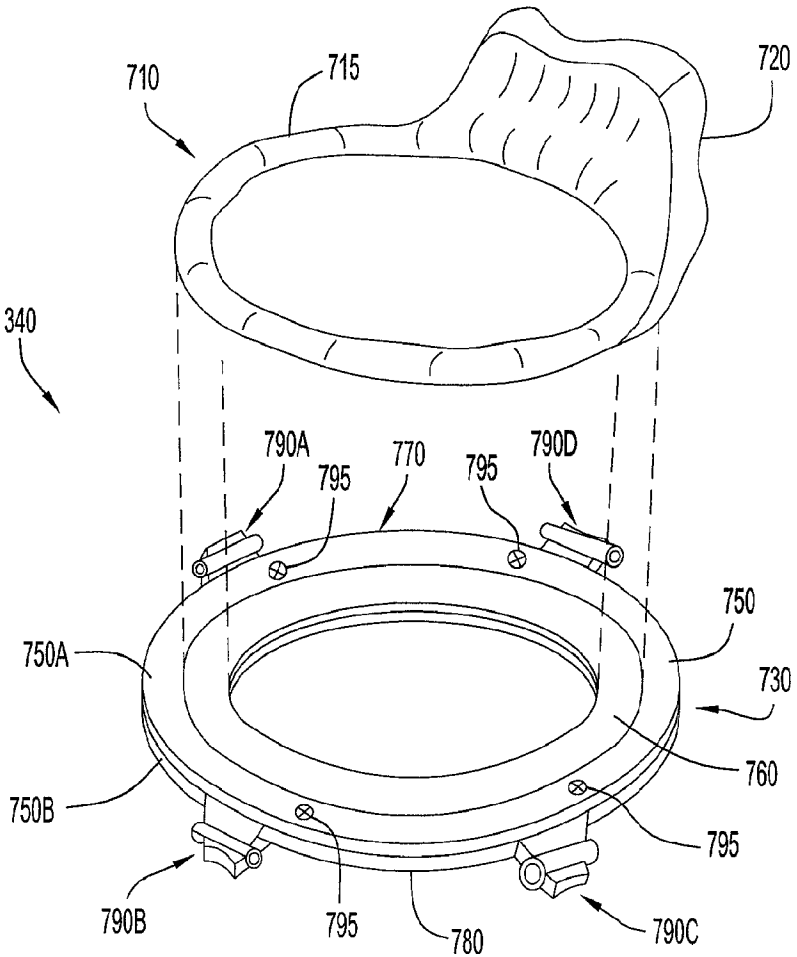
FIG. 7 illustrates a partially exploded view of the seat portion of the infant support structure illustrated in FIG. 3.
Figure 8:
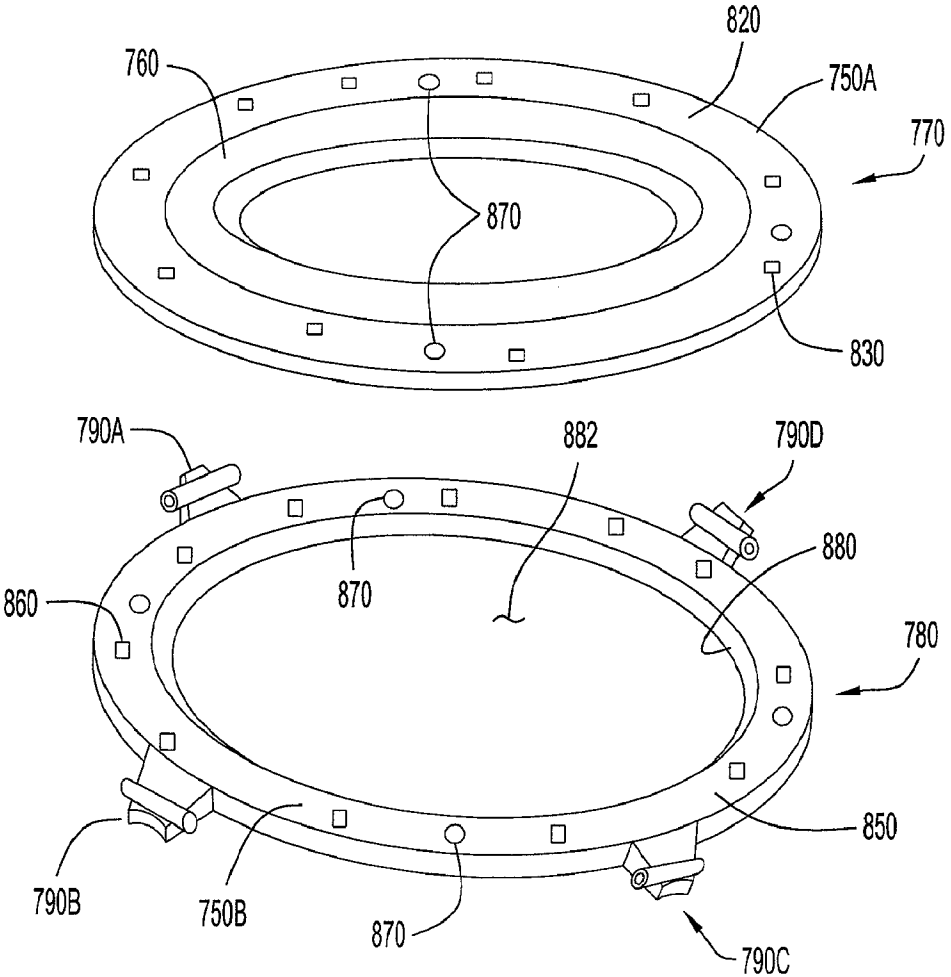
FIG. 8 illustrates an exploded perspective view of components of the seat portion illustrated in FIG. 7.
Figure 9:
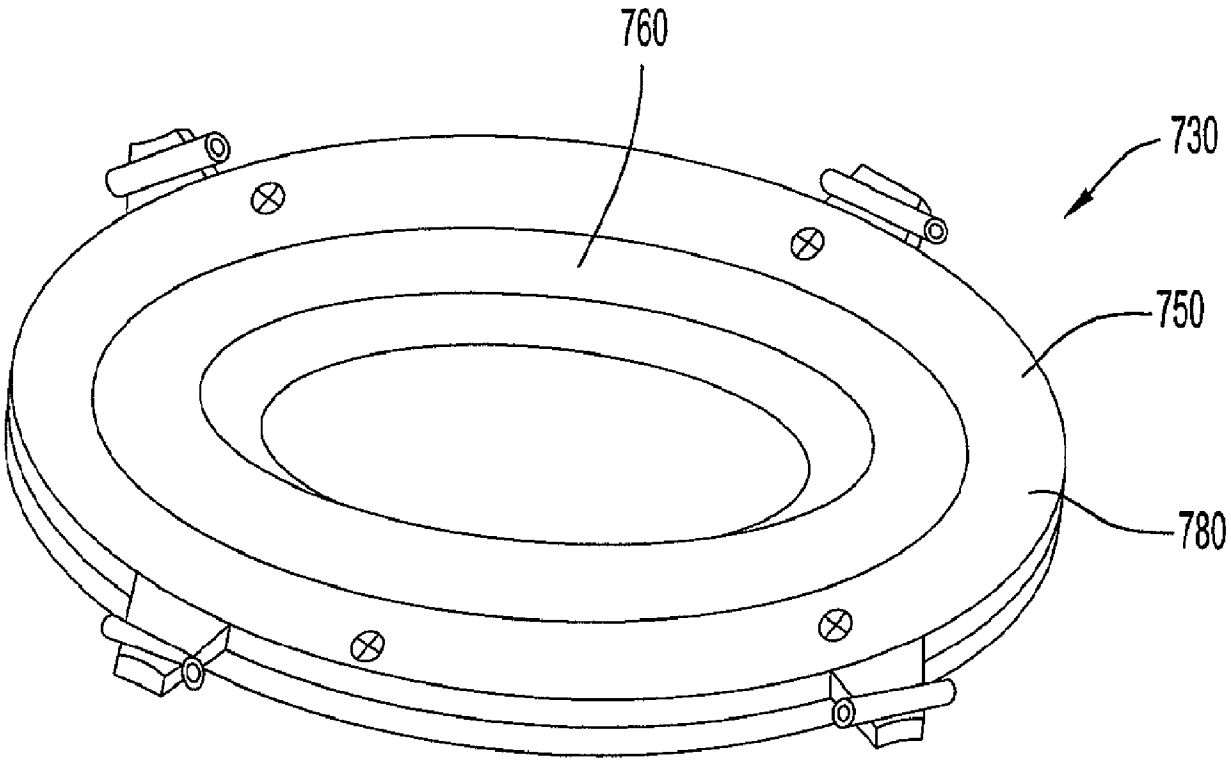
FIG. 9 illustrates a bottom perspective view of the components illustrated in FIG. 8.

FIGS. 7-9 shows an embodiment of a seat portion. FIG. 7 illustrates a partially exploded top perspective view of seat portion 340. Seat portion 340 includes a seat cushion 710 that is supported by a cushion support 730. In one implementation, the seat cushion 710 is made from a resilient material (e.g., resilient foam, or other soft or elastic material) that is formed into a body portion 715 and a back portion 720. The seat cushion 710 provides a comfortable surface for a child placed in seat portion 340. The cushion support 730 is formed from a rigid material (e.g., plastic or other moldable material) and includes an inner rotating member 760 that is rotatably mounted to an outer stationary member 750.

In one embodiment, the cushion support 730 has an upper portion 770 and a lower portion 780. The stationary member 750 includes an upper stationary member 750A on upper portion 770 and a lower stationary member 750B on lower portion 780. Cushion support 730 also includes fasteners or connectors 795 that are used to secure the stationary members 750A and 750B together. Furthermore, the lower portion 780 includes seat connectors 790A-D for connecting the seat portion 340 to the elastic member 350 and as a result, to the frame member 330.

FIG. 8 illustrates an exploded view of cushion support 730 which includes a lower perspective view of the upper seat portion 770 and an upper perspective view of lower seat portion 780. Rotatable member 760 is shown connected to upper stationary member 750A of the upper seat portion 770. In alternative embodiments, rotatable member 760 can instead be connected to lower seat portion 780. The upper stationary member 750A and the lower stationary member 750B also include openings 870 through which fasteners 795 may pass to secure upper and lower stationary portions 750A and 750B together.

As illustrated in FIG. 8, assembling cushion support 730 requires turning over the upper seat portion 770 so that the rotatable member 760 can be placed into the lower opening 882 in the lower seat portion 780 formed by edge 880. The assembled cushion support 730 is illustrated in FIG. 9.

Referring back to FIG. 8, upper stationary member 750A (shown upside down) includes a surface 820 and the lower stationary member 750B includes a surface 850. The surfaces 820 and 850 include fabric grips 830 and 860. The fabric grips 830 and 860 are used in the securing of material (such as a sheet of elastic fabric) in a compressed manner between the surfaces 820 and 850. The fabric grips 830 and 860 can have any shape or configuration, such as projections extending from the surface 820 that enter corresponding openings on surface 850.

Figure 10:
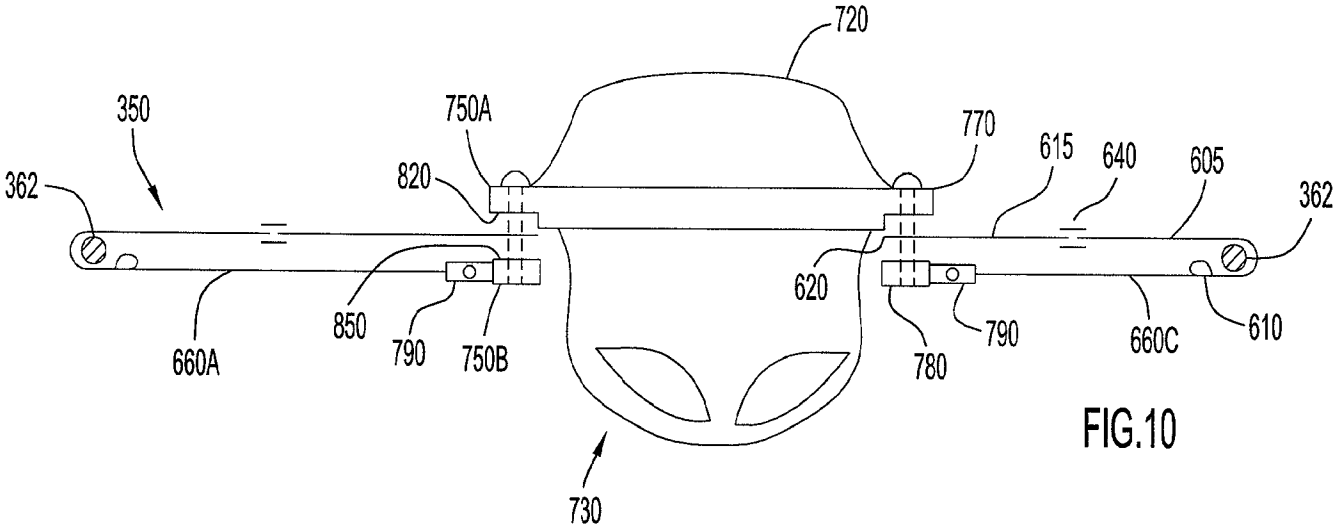
FIGS. 10 and 11 illustrate cross-sectional views of some components of the infant support structure illustrated in FIG. 3 in partially exploded and in assembled views, respectively.
Figure 11:
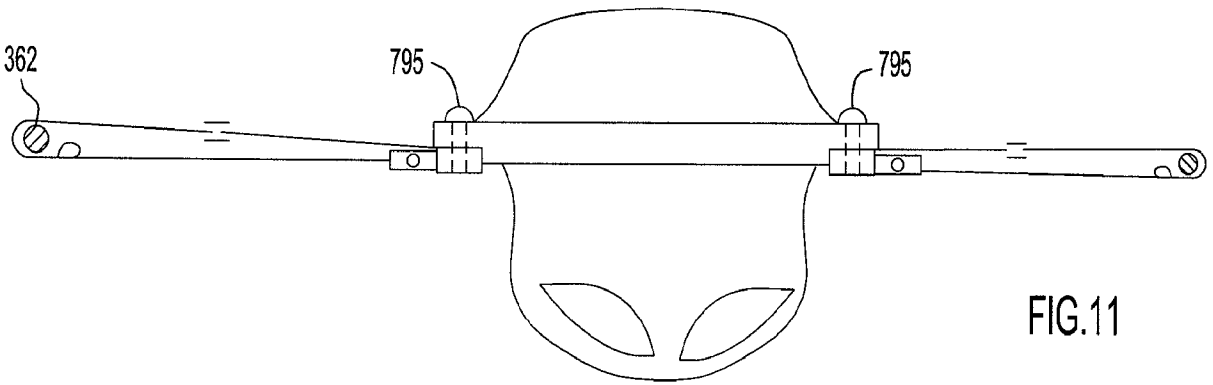

FIGS. 10-12 illustrate various components of the infant support structure 300. Referring to FIG. 10, a simplified cross-sectional view is illustrated showing the cushion support 730 separated into an upper seat portion 770 and a lower seat portion 780. The elastic member 350 is placed so that it extends around the upper portion 362. As shown, the inner fabric member 615 has its inner edge 620 is positioned between surface 820 of the upper stationary member 750A and the surface 850 of the lower stationary member 750B. The outer fabric member 605 is connected to the inner fabric member 615 by stitching 640. The outer edge 610 is wrapped around the upper portion 362 around the perimeter of the upper portion 362 of the frame.

On the underside of elastic member 350, limit members 660A and 660C are connected to seat connectors 790A and 790C, respectively, and to the outer edge 610. The upper seat portion 770 is connected to the lower seat portion 780 by fasteners 795, thereby capturing the inner edge 620 of the elastic member 350 between surfaces 820 and 850. As discussed above, fabric grips 830 and 860 reduce the likelihood that the inner edge 620 separates from between surfaces 820 and 850.

FIG. 12 illustrates a lower perspective view of components of the infant support structure 300, and in particular, the elastic portion 350 and the seat portion 1320. The elastic portion 350 is removably connected to the frame member 330. As previously described, the elastic portion 350 includes several spaced apart cutouts 625A-D. To connect the elastic portion 350 to the frame member 330, the outer edge 610 of the elastic member 350 is wrapped around upper portion 362 and the elastic portion 350 is arranged so that each of the cutouts 625A-D is aligned with one of the legs 400, 420, 440, and 460. The portions defining the cutouts 625A-D are placed around the legs 400, 420, 440, and 460 so that the outer edge 610 is located on the inner sides of the legs 400, 420, 440, and 460 below the upper member 362.

As previously described, hook ends 630A-D are connected to corresponding loops ends 635A-D so that the connector straps 655A-D form a continuous loop or connector strap around the perimeter of the upper portion 362. The continuous connector strap has smaller diameter than the upper member 362 so that the elastic member 350 cannot be inadvertently removed from the upper member 362, thereby requiring the decoupling of the hooks ends and the loop ends.

Referring to FIG. 12, each of the seat connectors 790A-D includes a support channel 1210A-D formed therethrough. Each of the legs 400, 420, 440, and 460 includes an upper leg connector that is connected to the upper frame member 362 and includes a flexible member support 1230A-D having a support channel 1240A-D formed therein. A flexible or resilient member 1250 (such as an elastic or bungee cord) passes alternately through each of the support channels 1210A-D and each of the support channels 1240A-D as shown, which in some embodiments can resemble a star-like pattern. The resilient member 1250 is an elongate member is forms a suspension mechanism for the infant support structure. In this configuration, the flexible member 1250 resiliently couples the seat portion 340 to the frame portion 330 at several locations on each of the portions 330 and 340. Therefore, when the seat portion 340 moves up and down or side-to-side between different positions, the flexible member 1250 bears at least a portion of the load transferred from seat portion 340 to frame member 330. The limit members 660A-D are attached to the elastic member 350 and the seat connectors 790. As a result, the limit members 660A-D limit the movement of the seat portion 340.

Figure 13:
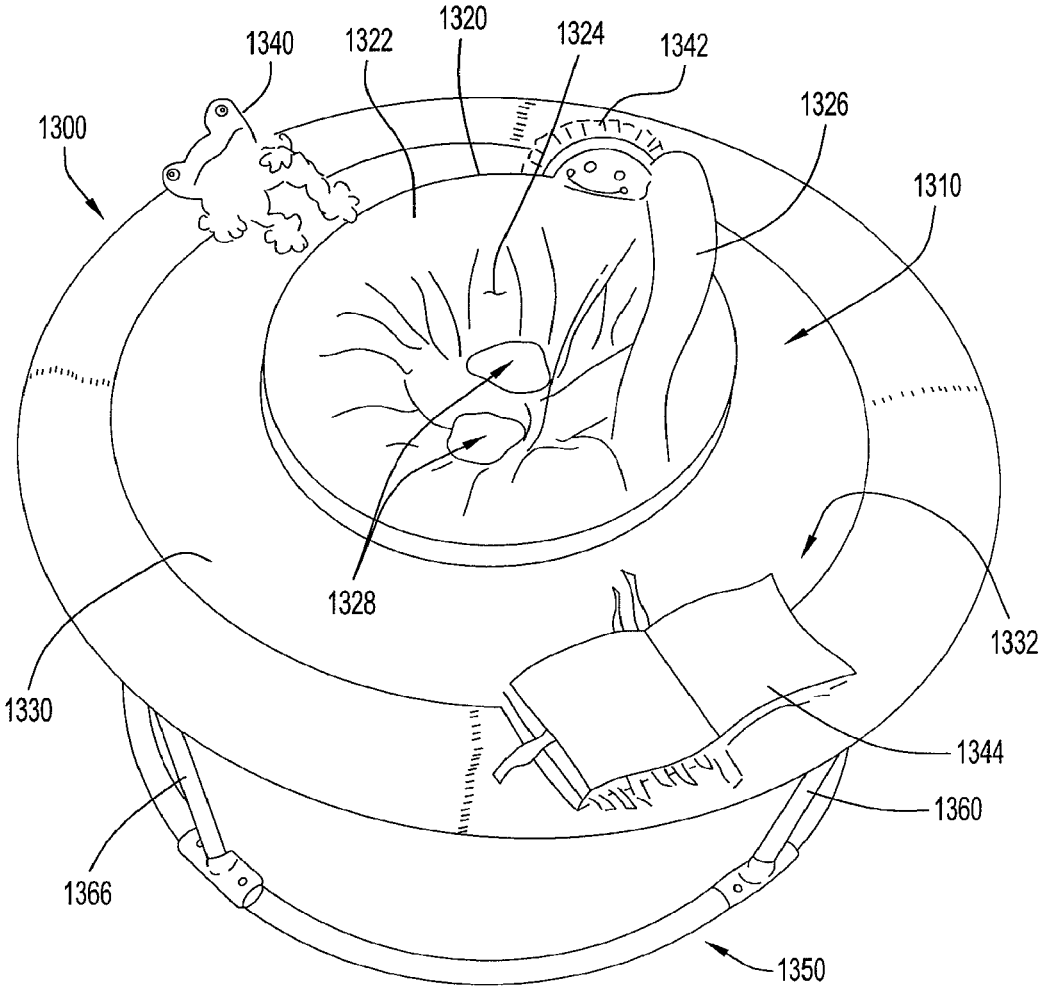
FIG. 13 illustrates a perspective view of the infant support structure illustrated in FIG. 12.

Referring to FIG. 13, a top perspective view of an embodiment of infant support structure is illustrated. In this embodiment, the infant support structure 1300 includes a support portion 1310 and a frame portion 1350. The frame portion 1350 includes several legs, only legs 1360 and 1366 are illustrated. The support portion 1310 includes a seat portion 1320 and a fabric portion 1330. The seat portion 1320 includes a cover 1322, such as a fabric cover, that covers a seat cushion, including the back portion 1326, and forms a seat pocket or receptacle 1324 in which an infant can be placed. The seat pocket 1324 extends downwardly to leg openings 1328 formed in the fabric cover 1322 which are configured for the legs of a child.

As shown, the top or upper surface of the elastic member or portion 1330 is positioned so that it forms an activity surface 1332 in proximity to a child positioned in the seat portion 1320. Various objects 1340, 1342, and 1344, such as toys, can be coupled to or simply placed on the activity surface 1332 within reach of the child. As a child bounces up and down and side-to-side in the seat portion 1320, the vibrations created by the movement of the child are imparted to the objects 1340, 1342, and 1344, which move accordingly and provide sensory stimulation for the child. Thus, the entertainment of the child is enhanced by the fact that the child can move and see the resulting movement of the objects 1340, 1342, and 1344.

Figure 14:
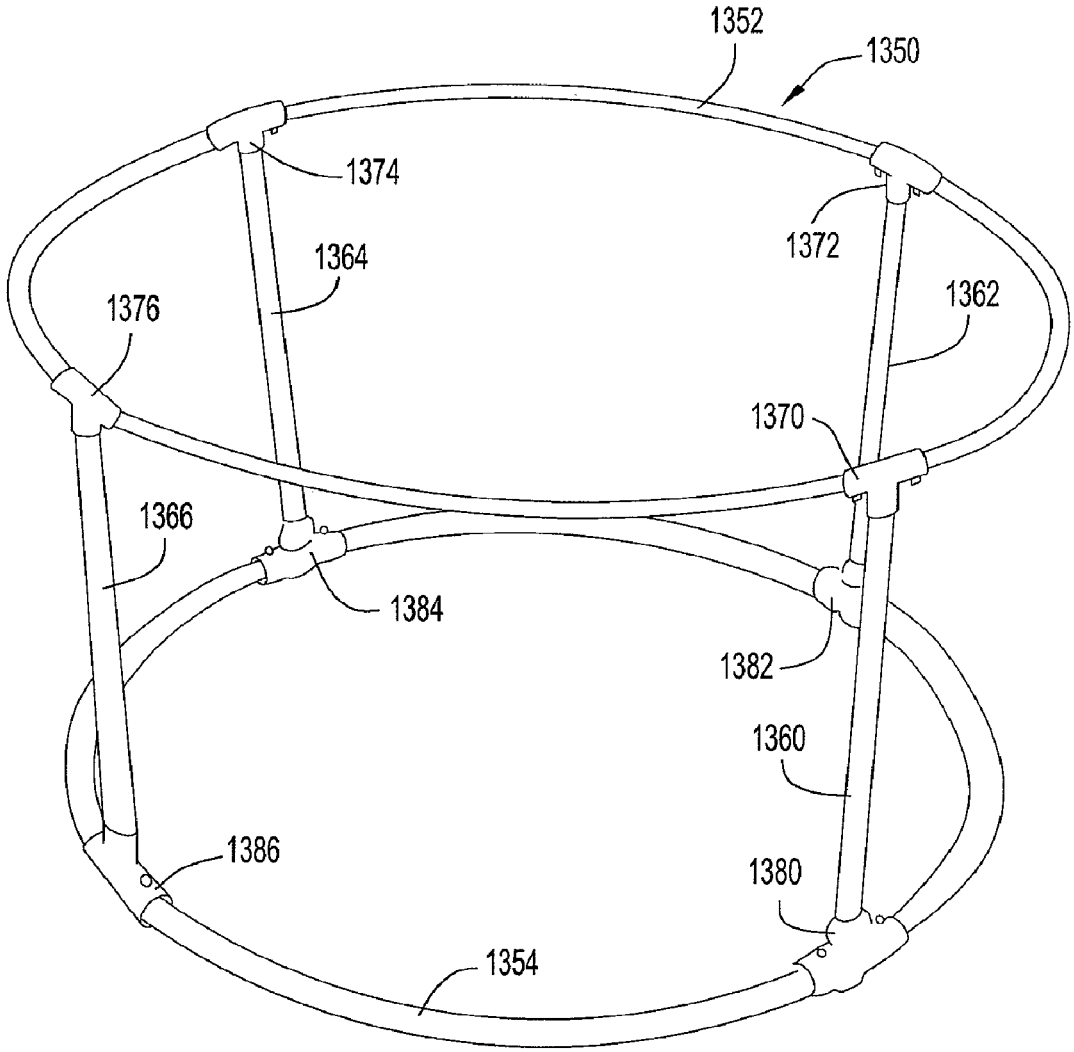
FIGS. 14 and 15 illustrate assembled and exploded perspective views of the frame member of the infant support structure illustrated in FIGS. 12 and 13.
Figure 15:
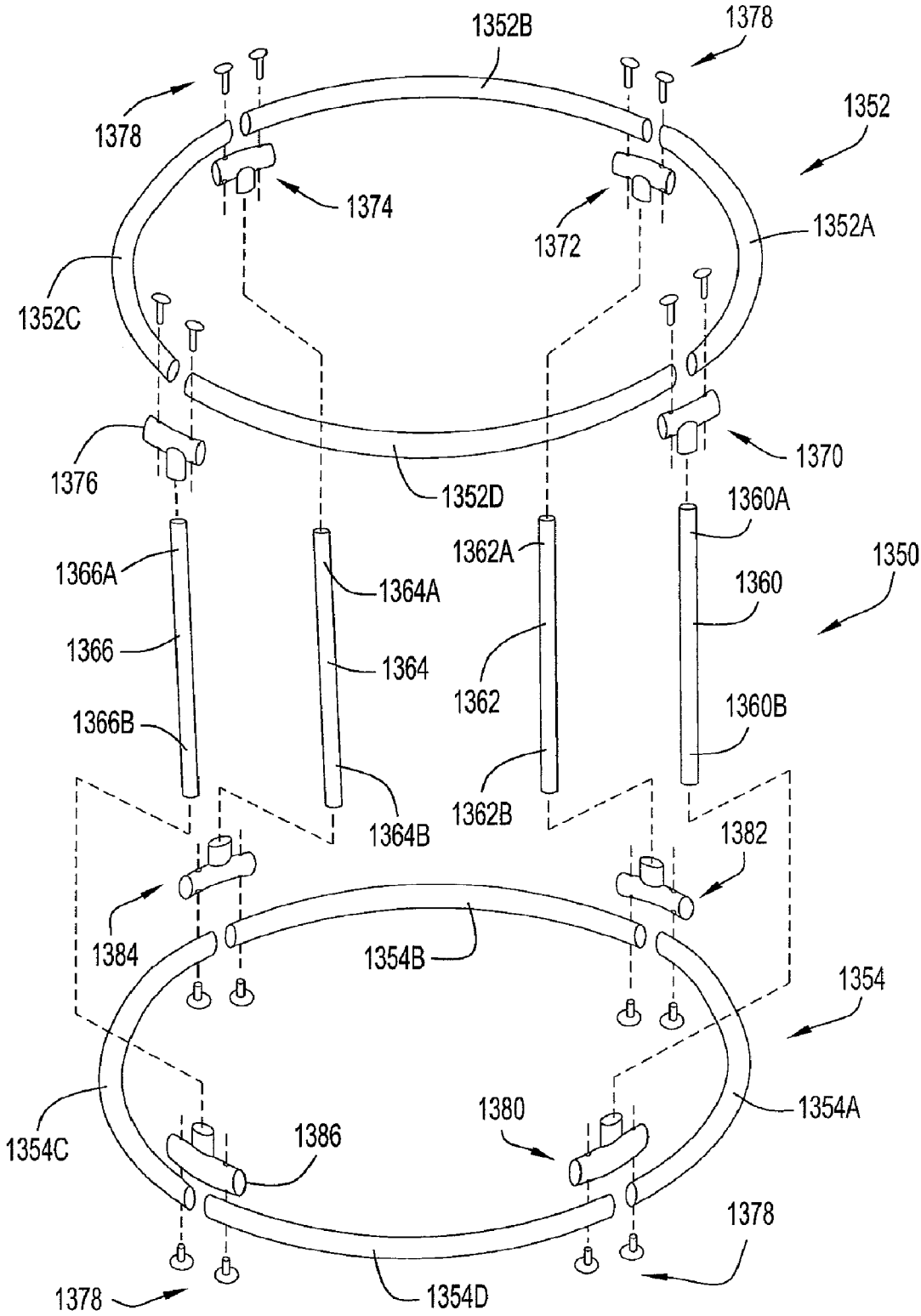

Referring to FIGS. 14 and 15, the frame 1350 of infant support structure 1300 is illustrated. In this embodiment, the frame 1350 includes an upper portion 1352 and a lower portion 1354. In different embodiments, the upper and lower portions 1352 and 1354 can be formed using one or more arcuate members. As shown in FIG. 15, the upper portion 1352 includes several members 1352A-D that collectively form the upper portion 1352. Similarly, the lower portion 1354 includes several members 1354A-D that collectively form the lower portion 1354.

The frame member 1350 includes several legs 1360, 1362, 1364, and 1366 that are coupled to the upper portion 1352 and the lower portion 1354. In particular, the leg upper ends 1360A, 1362A, 1364A, and 1366A are coupled to connectors 1370, 1372, 1374, and 1376, respectively, via a friction fit and/or connectors 1378. Similarly, the leg lower ends 1360B, 1362B, 1364B, and 1366B are coupled to connectors 1380, 1382, 1384, and 1386, respectively, via a friction fit and/or connectors 1378. Alternatively, the legs 1360, 1362, 1364, and 1366 can be threaded to be coupled to the connectors.

Figure 16:
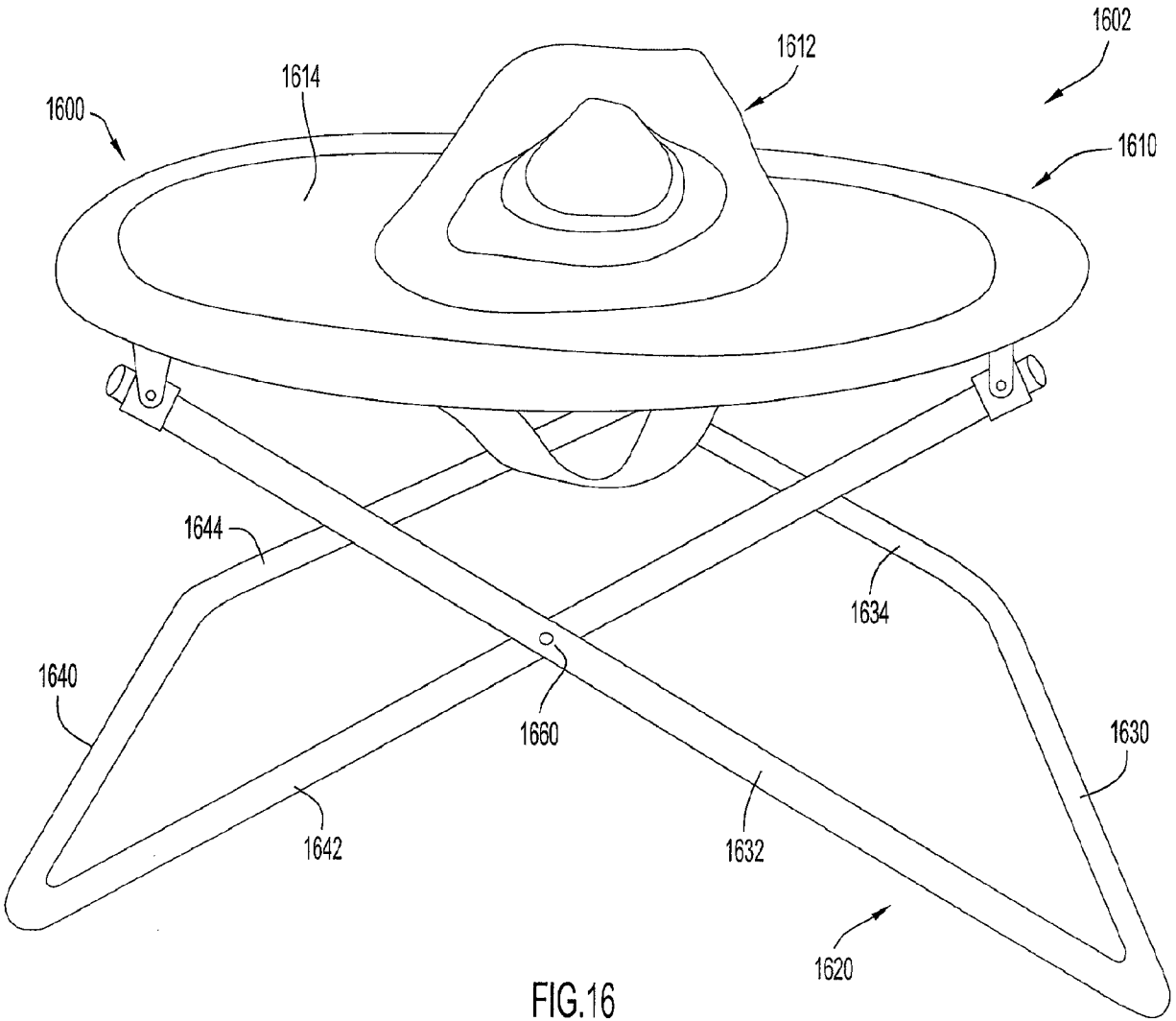
FIG. 16 illustrates a perspective view of an alternative embodiment of an infant support structure according to the invention.
Figure 17:
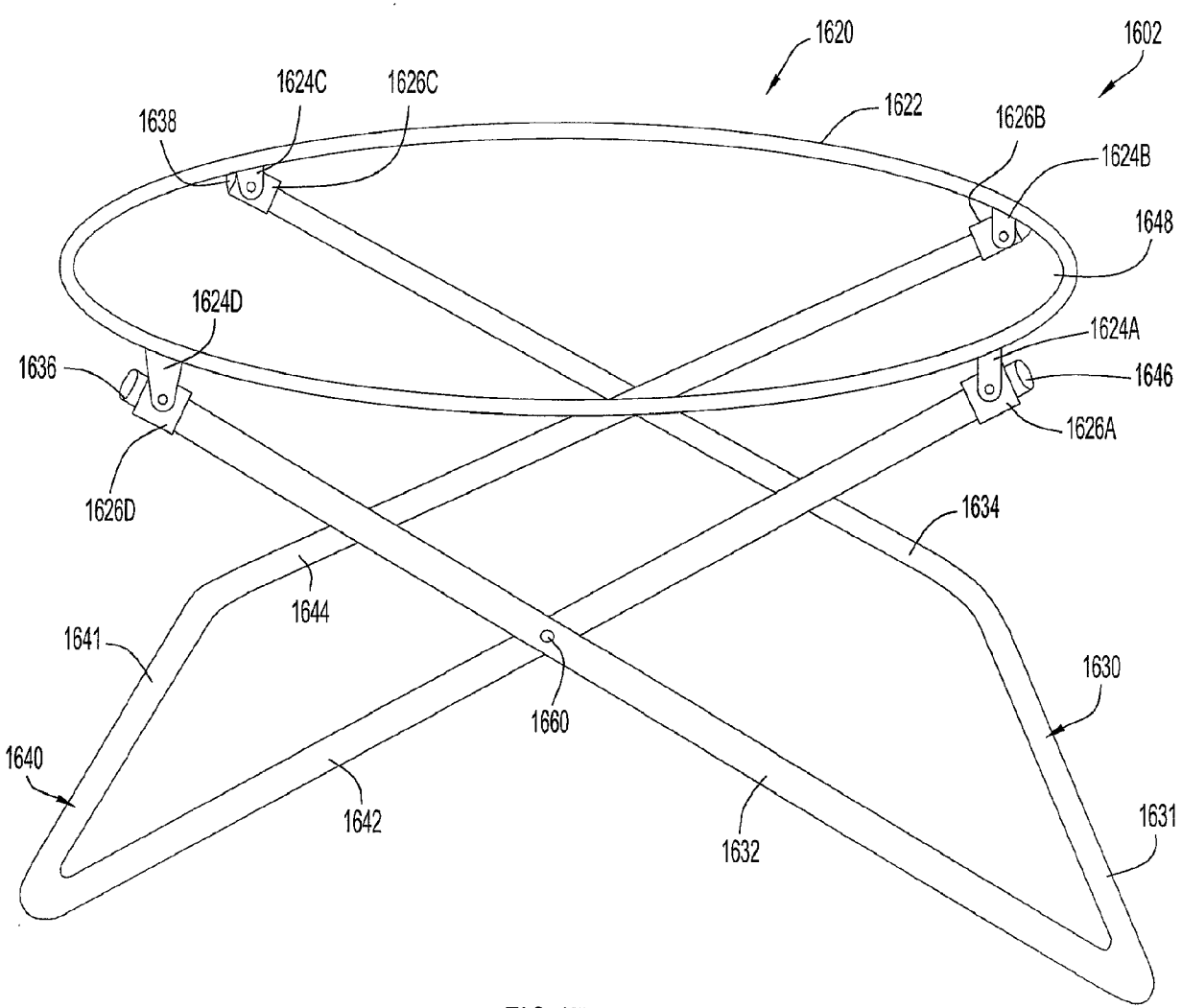
FIG. 17 illustrates a perspective view of the frame member of the infant support structure illustrated in FIG. 16 in a deployed configuration.
Figure 18:
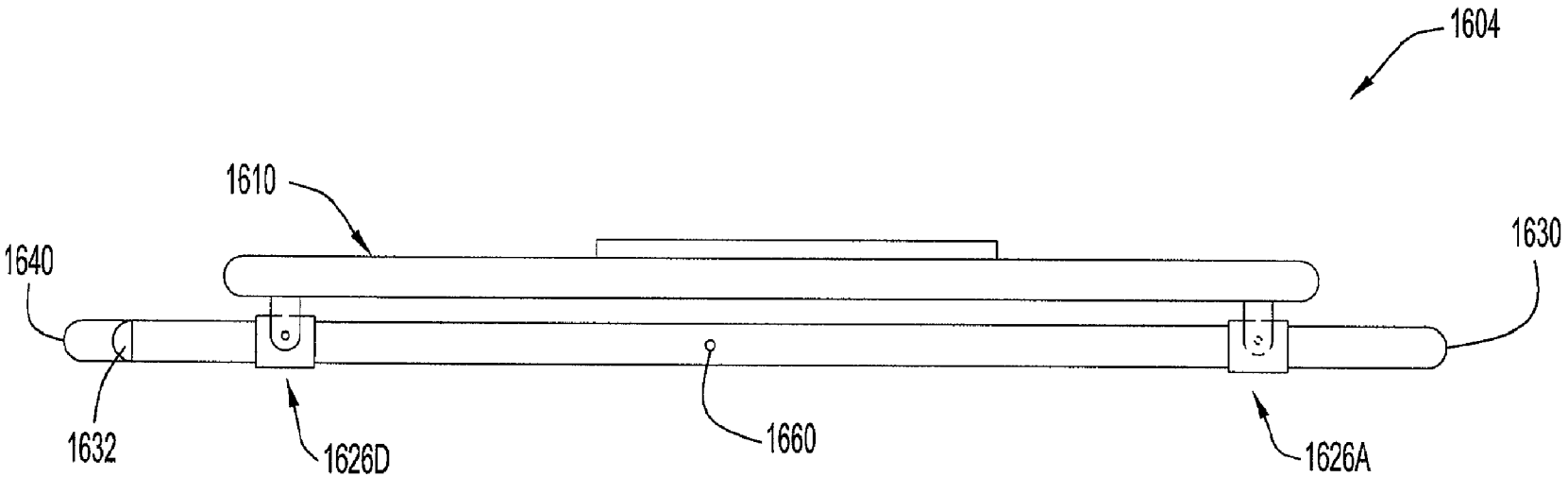
FIG. 18 illustrates a side view of the frame member illustrated in FIG. 17 in a collapsed configuration.

FIGS. 16-18 illustrate another embodiment of an infant support structure. The infant support structure 1600 is illustrated in a deployed configuration 1602 in FIGS. 16 and 17 and in a collapsed configuration 1604 in FIG. 18. The infant support structure 1600 includes a support portion 1610 and a frame portion 1620. The support portion 1610 includes a seat portion 1612 in which an infant can be placed. The support portion 1610 includes an elastic portion 1614 that has elastic properties such that the seat portion 1612 can bounce up and down and move side-to-side relative to the frame portion 1620. The elastic portion 1614 enables a child in the seat portion 1612 to bounce and move in any desired direction and functions as a trampoline-like structure.

The frame portion 1620 includes legs 1630 and 1640 that are pivotally coupled to each other. Leg 1630 is substantially U-shaped with a lower support surface engaging part 1631 and two leg members 1632 and 1634 that have ends 1636 and 1638, respectively. Similarly, leg 1640 is substantially U-shaped with a lower support surface engaging part 1641 and two leg members 1642 and 1644 that have ends 1646 and 1648, respectively. Leg members 1632 and 1642 are coupled together by a connector 1660. Similarly, leg members 1634 and 1644 are coupled together by a connector (not shown).

Referring to FIG. 17, the frame portion 1620 is illustrated with the support portion 1610 removed therefrom. As shown, the legs 1630 and 1640 form a collapsible, generally X-shaped structure when viewed from a side. In one embodiment, each of the legs 1630 and 1640 is slidably coupled to the upper portion 1622 of the frame 1620. The upper portion 1622 includes several mounting components 1624A-D, each of which has a sleeve 1626A-D pivotally coupled thereto.

The leg members 1632, 1634, 1642, and 1644 are inserted into and slidably coupled to sleeves 1626D, 1626C, 1626B, and 1626A, respectively. The upper ends 1636, 1638, 1646, and 1648 of the legs are configured to prevent the separation of the legs 1630 and 1640 from the sleeves. For example, the upper ends 1636, 1638, 1646, and 1648 may be formed with a portion having a diameter greater than that of the sleeves 1626A-D. Alternatively, a separate piece may be coupled to the upper ends 1636, 1638, 1646, and 1648 which may have a larger diameter than that of the sleeves 1626A-D. Accordingly, the frame member 1620 is collapsible by allowing the upper ends 1636, 1638, 1646, and 1648 to slide relative to sleeve connectors 1626A-D until the frame member 1620 is in its collapsed configuration as illustrated in FIG. 18.

Figure 19:
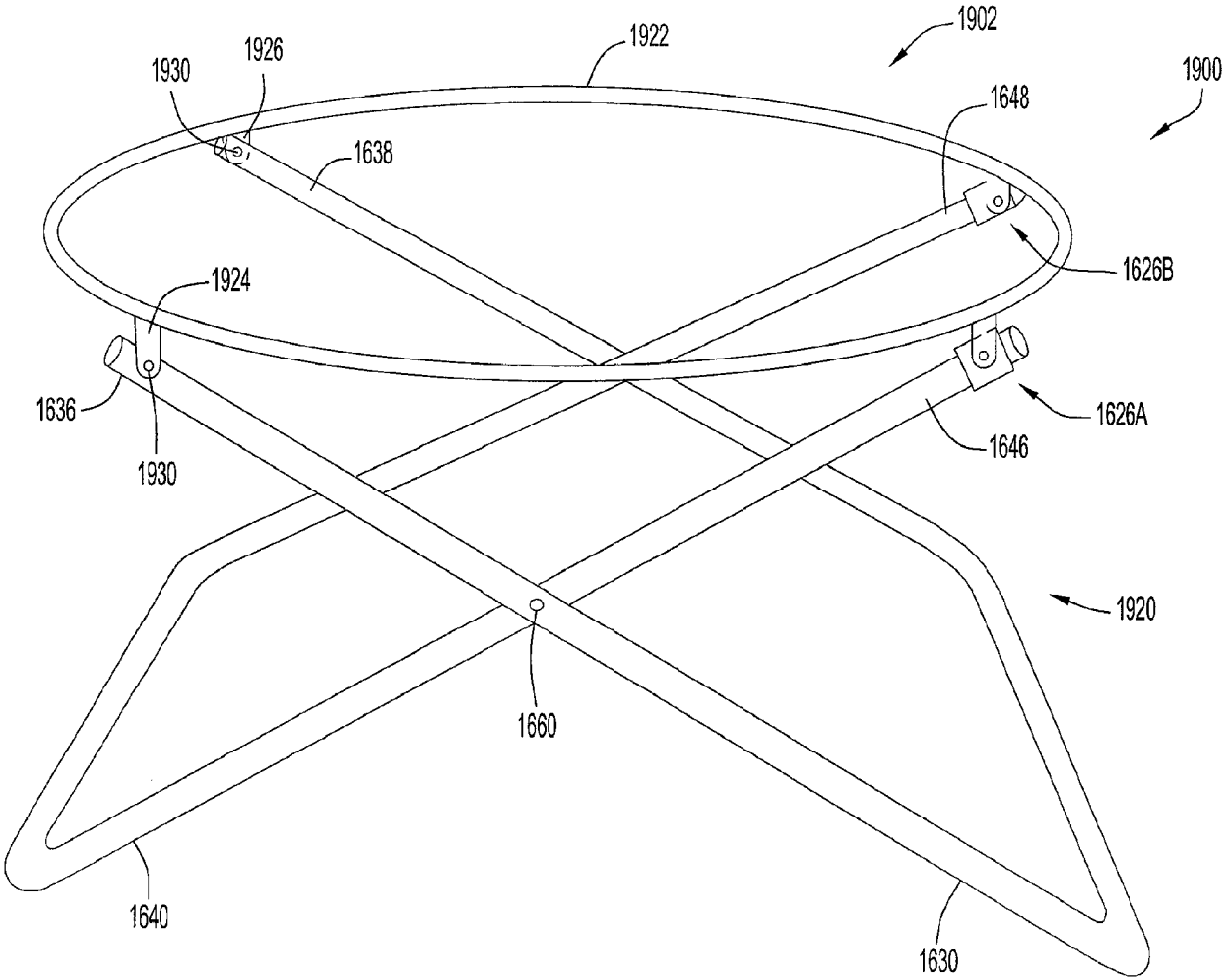
FIG. 19 illustrates a perspective view of an alternative embodiment of the frame member according to the invention.
Figure 20:
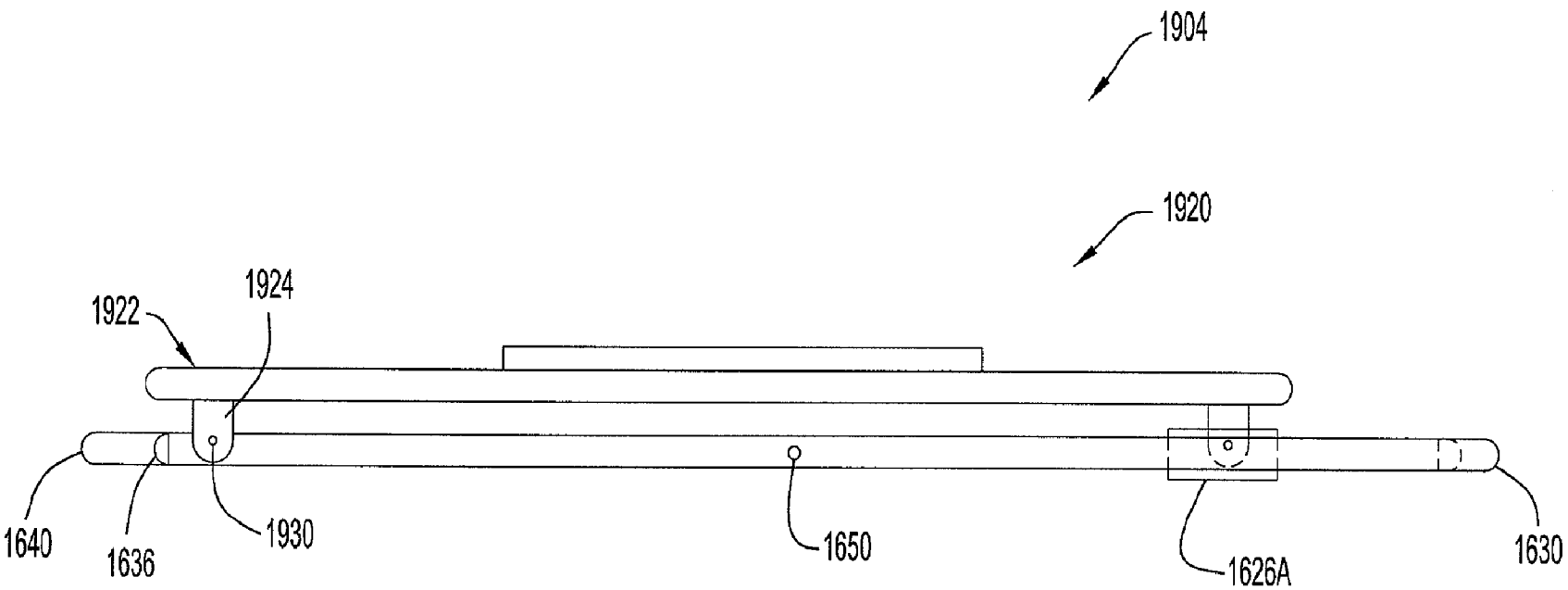
FIG. 20 illustrates a side view of the infant support structure illustrated in FIG. 19 in a collapsed configuration.

FIGS. 19 and 20 illustrate a perspective view of another embodiment of a frame member. The components of frame member 1900 that are similar to components of frame member 1600 illustrated in FIGS. 16-18 have common reference numerals for ease of reference. The frame member 1900 is illustrated in a deployed configuration 1902 in FIG. 19 and in a collapsed configuration 1904 in FIG. 20.

The frame 1900 includes an upper portion 1922 with mounts 1924 and 1926 to which the upper ends 1636 and 1638 of the leg 1630 are pivotally coupled via connectors 1930. In this embodiment, leg 1640 is slidably mounted to the upper portion 1922 in a similar configuration as described with respect to infant support structure 1600. As the leg 1630 pivots relative to the upper portion 1922, leg 1640 slides relative to the upper portion 1922 as the frame is collapsed to its collapsed configuration 1904 illustrated in FIG. 20.

Figure 21:
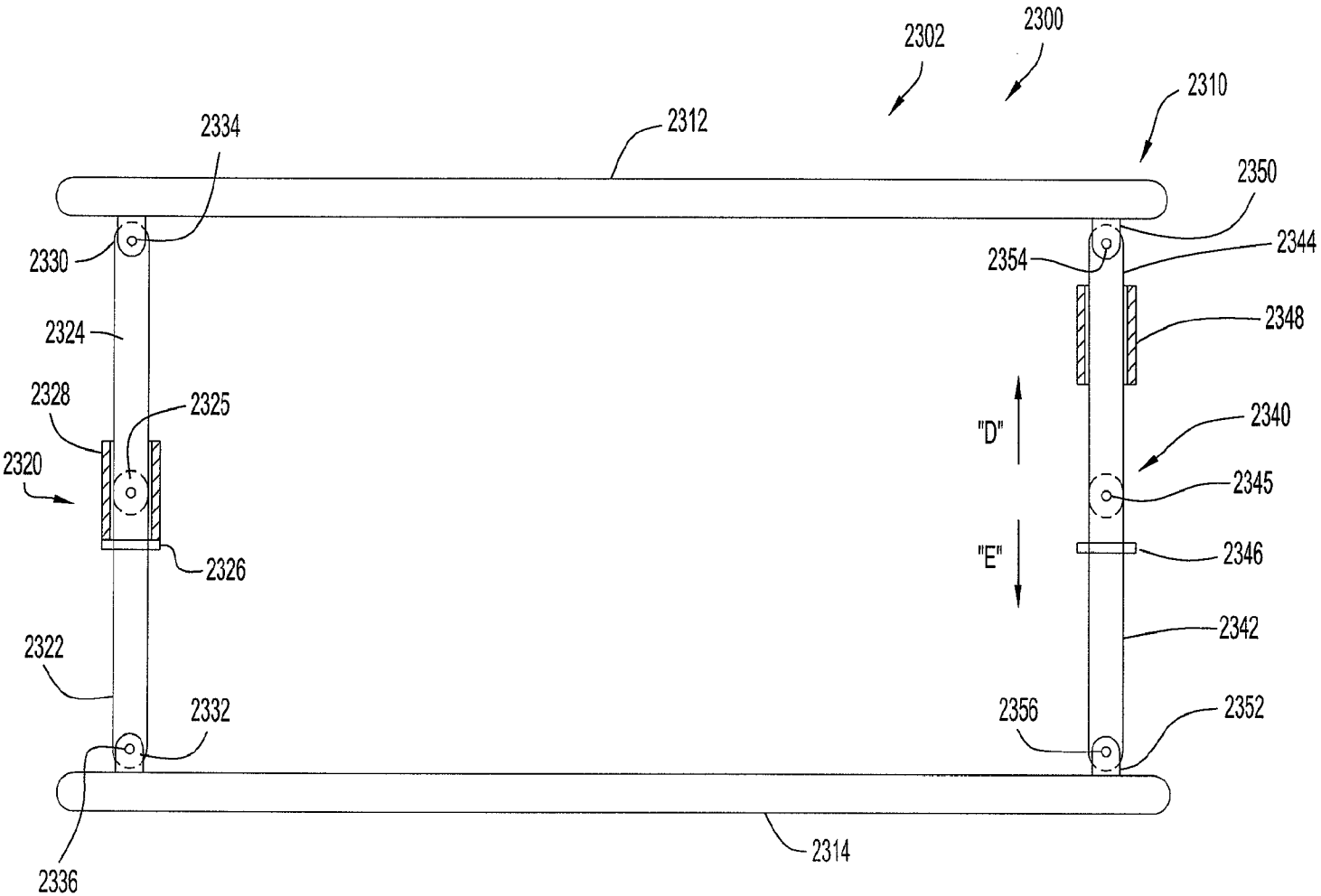
FIG. 21 illustrates a side view of an alternative embodiment of a frame member for an infant support structure according to the invention.
Figure 22:
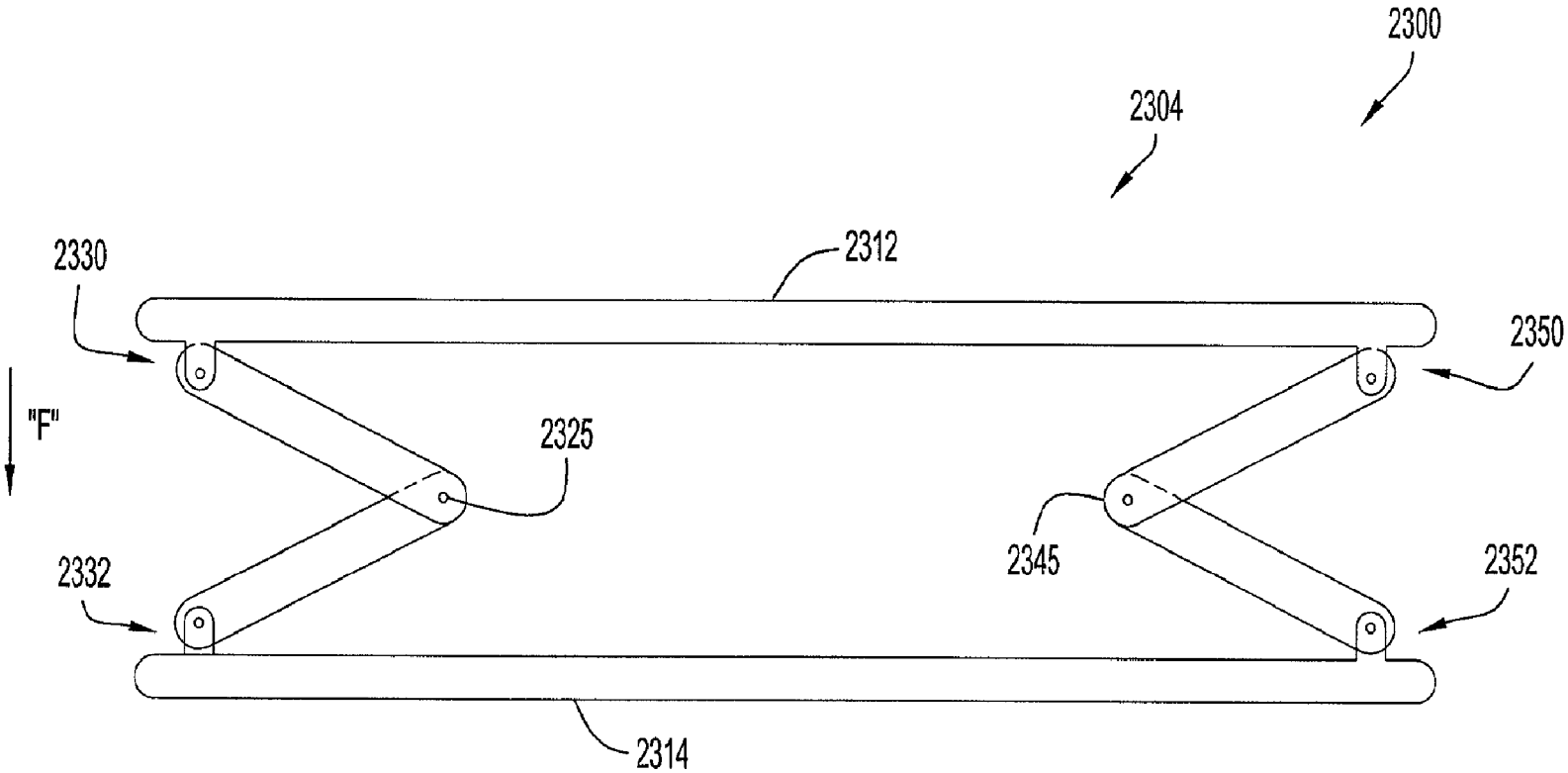
FIG. 22 illustrates a side view of the frame member illustrated in FIG. 21 in a partially collapsed configuration.
Figure 23:
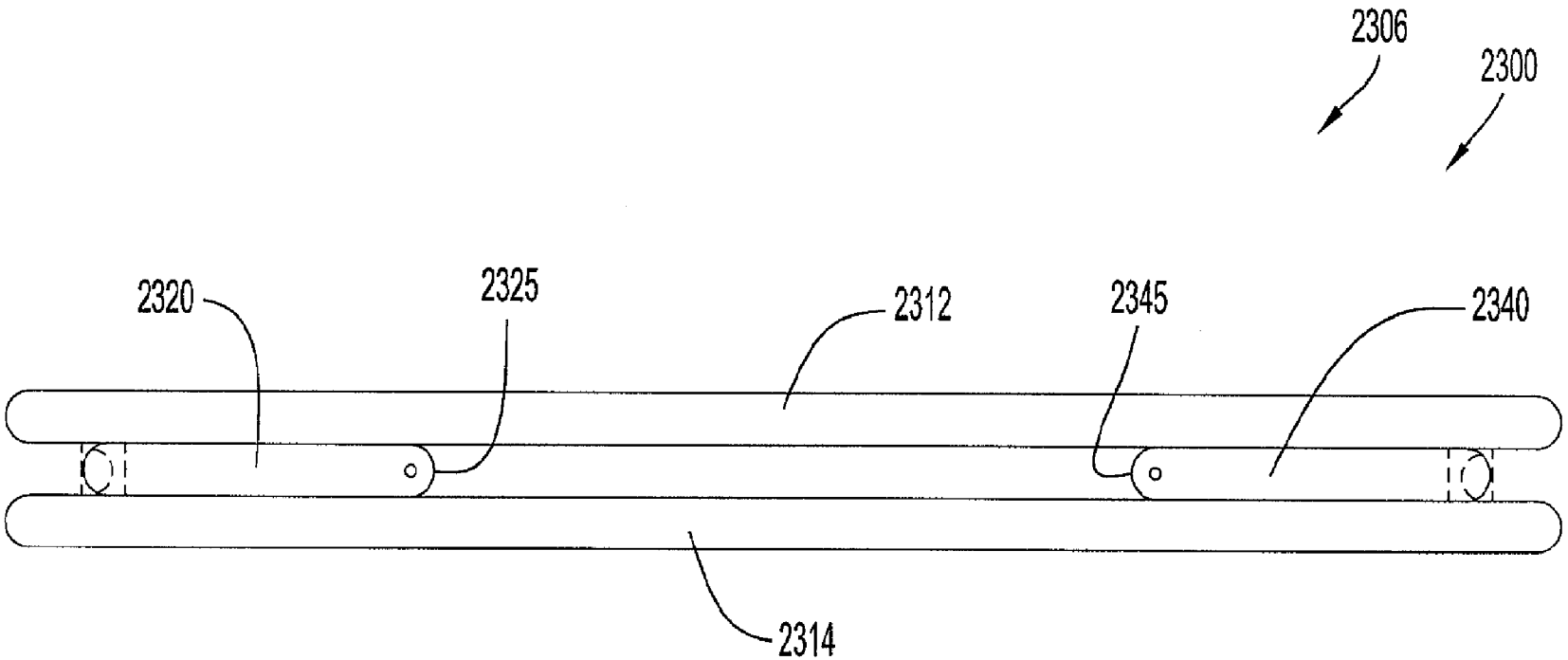
FIG. 23 illustrates a side view of the frame member of FIG. 21 in a collapsed configuration.

Referring to FIGS. 21-23, another embodiment of an infant support structure is illustrated. In this embodiment, the infant support structure 2300 is collapsible and can be placed in a deployed or use configuration 2302 (see FIG. 21), a partially collapsed configuration 2304 (see FIG. 22), and a collapsed configuration 2306 (see FIG. 23).

In this embodiment, the frame member 2310 includes several legs that are coupled to an upper portion 2312 and a lower portion 2314. The upper portions 2312 and the lower portion 2314 may be formed by one or more members, similar to other embodiments described above. In FIGS. 21-23, only two legs of the frame member 2310 are illustrated for each of reference. In other embodiments, the frame member 2310 may include more than two legs.

Referring to FIG. 21, leg 2320 includes an upper leg portion 2324 and a lower leg portion 2322 that are pivotally coupled together via a pivot connection 2325 by a connector, such as a bolt. The upper end of leg portion 2324 is coupled to a mount 2330 on the upper portion 2312 by a connector 2334. The lower end of leg portion 2322 is coupled to a mount 2332 on the lower portion 2314 by a connector 2336.

Similarly, leg 2340 includes an upper leg portion 2344 and a lower leg portion 2342 that are pivotally coupled together via a pivot connection 2345 by a connector, such as a bolt. The upper end of leg portion 2344 is coupled to a mount 2350 on the upper portion 2312 by a connector 2354. The lower end of leg portion 2342 is coupled to a mount 2352 on the lower portion 2314 by a connector 2356.

In one embodiment, each of the legs 2320 and 2340 includes a sleeve 2328 and 2348 slidably mounted thereon. The sleeves 2328 and 2348 are made of a rigid or semi-rigid material. The sleeves 2328 and 2348 are illustrated in FIG. 21 in cross-section and are not illustrated in FIGS. 22-23 for ease of reference. Each of the legs 2320 and 2340 includes a limit or a stop 2326 and 2346 that limits the range of motion of a corresponding sleeve 2328 or 2348. The limits 2326 and 2346 are located so that a sleeve engaged therewith is positioned over the pivoting joint between the leg portions to prevent the relative movement of the leg portions, thereby maintaining the legs in their fully extended configurations.

Referring to FIG. 21, sleeve 2328 on leg 2320 has been moved downwardly along the direction of arrow "E" so that it engages the stop 2326 and is surrounding pivot joint 2325. In this position, the sleeve 2328 prevents the pivot joint 2325 from moving and as a result, the leg portions 2322 and 2324 cannot pivot relative to each other. Accordingly, leg 2320 is maintained in its deployed or use configuration.

Also in FIG. 21, the sleeve 2348 has been moved upwardly along the direction of arrow "D." In this position, the sleeve 2348 does not prevent pivot joint 2345 from moving and as a result, leg 2340 can be collapsed. To collapse the frame 2300, sleeves 2328 and 2348 are both raised along the direction of arrow "D" to move the sleeves 2328 and 2348 upwardly. Conversely, sleeves 2328 and 2348 are lowered over pivot joints 2325 and 2345 and into engagement with stops 2326 and 2346, respectively, to lock the legs 2320 and 2340 in their deployed positions.

Referring to FIG. 22, the legs 2320 and 2340 are collapsible after sleeves 2328 and 2348 (not shown in FIG. 22) have been moved upwardly to their unlocking positions. In the partially collapsed position, the upper and lower leg members 2322, 2324, 2342, and 2344 pivot at pivot joints 2325 and 2345 relative to each other. FIG. 23 shows frame member 2310 in a fully collapsed configuration, which facilitates storage and transportation of the infant support structure 2310.

Figure 24:
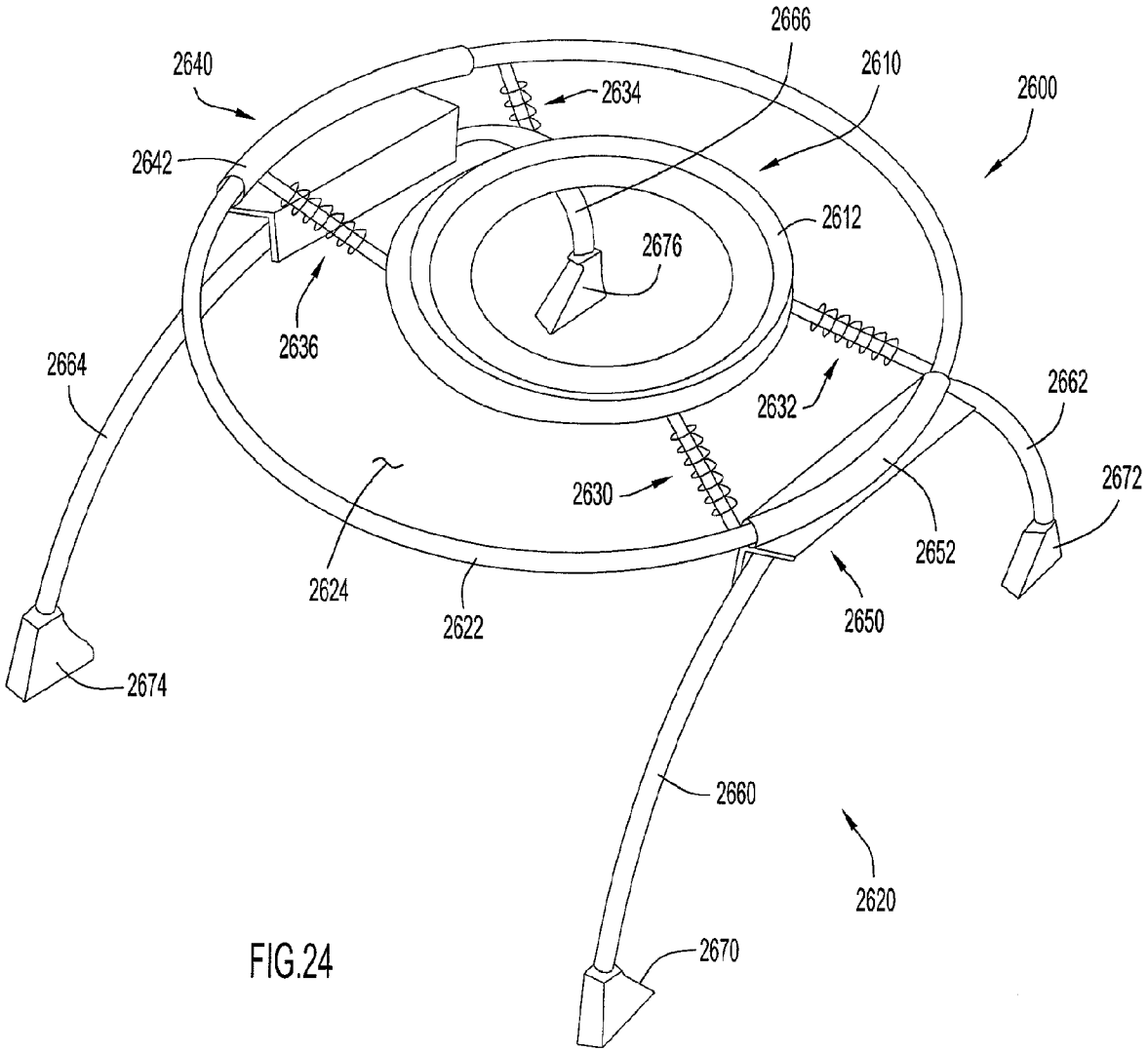
FIG. 24 illustrates a perspective view of an alternative embodiment of an infant support structure.

FIG. 24 shows an alternative embodiment of an infant support structure. In this embodiment, the infant support structure 2600 includes a support portion 2610 and a frame member 2620. On one side, the frame member 2620 includes legs 2660 and 2662, which have feet 2670 and 2672 and are coupled to housing 2650. The legs 2660 and 2662 may be metal, plastic, or other suitable material, and are coupled to the housing 2650 by friction and/or connectors. On the other side, the frame member 2620 includes legs 2664 and 2666, which have feet 2674 and 2676 and are coupled to housing 2640 in a manner similar to legs 2660 and 2662. The feet 2670, 2672, 2674, and 2676 may be made from an anti-slip material to ensure a stable connection between the infant support structure 2600 and a support surface.

The frame member 2620 includes an upper member 2622 that is substantially circular and defines an opening 2624 in which a seat support or portion 2612 is located. Several elastic elements 2630, 2632, 2634, and 2636, such as metallic springs or spring-like members, are connected to and extend between upper member 2622 and the seat portion 2612. The elements may be connected by connectors or fasteners (not shown). Housing 2640 includes a tubular sleeve portion 2642 through which the upper member 2622 extends. Similarly, housing 2650 includes a tubular sleeve portion 2652 through which the upper member 2622 extends.

While not illustrated in FIG. 24, an elastic member can be connected to the upper portion 2622 of the frame 2620 and to seat portion 2612. The elastic member can be placed so that it extend over the elastic elements 2630, 2632, 2634, and 2636. In this embodiment, the elastic elements 2630, 2632, 2634, and 2636 perform generally the same function as flexible members 1250 illustrated in FIG. 12.

In alternative embodiments, the shape of the upper portion, the seat portion, the elastic member can be any shape including square, triangle, rectangle octagon etc. or other non-polygonal shape. In various embodiments, elastic or resilient members may include springs or spring-like members (metallic or other material), or stretchable cords, such as bungee cords. In alternative embodiments, the components of a frame may be formed of metal, plastic, or another material with sufficient strength.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. An infant support structure comprising:

a seat portion having an outer perimeter, the seat portion being configured to support an infant;

a frame including an upper portion and a support portion coupled to the upper portion, the support portion being configured to engage a support surface, the upper portion substantially surrounding the seat portion; and an elastic member coupled to the frame and to the seat portion, the elastic member substantially surrounding the seat portion, the elastic member resiliently supporting the seat portion for bouncing movement relative to the support surface and the frame in response to bouncing movement by the infant in the seat portion.

2. The infant support structure of claim 1, wherein the upper portion of the frame is substantially circular and surrounds the outer perimeter of the seat portion.

3. The infant support structure of claim 1, wherein the elastic member is a stretchable fabric material that extends between the seat portion and the frame.

4. The infant support structure of claim 3, further comprising:

an object coupled to the elastic member, movement of a child in the seat portion results in movement of the elastic member, and movement of the elastic member imparts movement to the object.

5. The infant support structure of claim 1, further comprising:

a resilient member coupled to the frame and to the seat portion, the resilient member supporting the seat portion from the frame.

6. The infant support structure of claim 5, wherein the resilient member is an elongate member that is coupled to the frame and the seat portion.

7. The infant support structure of claim 5, wherein the resilient member is located beneath the elastic member.

8. A structure for supporting a person above a support surface, the structure comprising:

a frame including an outer member and legs supporting the outer member above the support surface;

a seat configured to receive a child therein;

a suspension mechanism coupled to the frame outer member and to the seat, the suspension mechanism resiliently supporting the seat for reciprocating movement relative to the support surface and the frame in response to reciprocating movement by the child in the seat; and an elastic member coupled to the frame outer member and to the seat, the elastic member being substantially planar and configured to support objects placed thereon.

9. The structure of claim 8, wherein the suspension mechanism supports the seat from the frame, the seat being movable relative to the frame.

10. The structure of claim 9, wherein the suspension mechanism is an elastic elongate member that is coupled to the seat and to the frame.

11. The structure of claim 8, wherein the elastic member is a stretchable fabric material.

12. The structure of claim 11, wherein the outer member of the frame defines a substantially circular opening, the seat is placed in the opening, and the elastic member is disposed between the outer member and the seat and surrounds the seat.

13. The structure of claim 12, wherein at least one toy is coupled to the elastic member and configured to move when motion is imparted to the elastic member.

14. An infant support structure comprising:

a seat configured to receive an infant;

a frame configured to engage a support surface;

an elastic coupler connected to the seat and to the frame, the coupler resiliently supporting the seat from the frame for reciprocating movement relative to the support surface and the frame in response to reciprocating movement by the infant in the seat; and an elastic member connected to the seat and to the frame, the elastic member substantially surrounding the seat.

15. The infant support structure of claim 14, wherein the coupler configured to bear a portion of a weight of an infant placed in the seat.

16. The infant support structure of claim 15, wherein the coupler is an elongate member that is coupled to the frame at a plurality of locations and to the seat at a plurality of locations.

17. The infant support structure of claim 14, further comprising:

a limit mechanism connected to the frame and to the seat, the limit mechanism configured to limit the extent of movement of the seat relative to the support surface.

18. The infant support structure of claim 17, wherein the limit mechanism includes a flexible material.

19. The infant support structure of claim 14, wherein the coupler is disposed beneath the elastic member.

20. The infant support structure of claim 13, wherein the frame is collapsible.

* * * * *